US011937748B1

(12) United States Patent
Hilgers

(10) Patent No.: US 11,937,748 B1
(45) Date of Patent: Mar. 26, 2024

(54) METHOD AND SYSTEM FOR PROVIDING A SELF-RETAINING WRISTBAND DISPENSER FOR LIQUIDS OR GELS

(71) Applicant: Andy Alexander Hilgers, Los Angeles, CA (US)

(72) Inventor: Andy Alexander Hilgers, Los Angeles, CA (US)

( * ) Notice: Subject to any disclaimer, the term of this patent is extended or adjusted under 35 U.S.C. 154(b) by 0 days.

(21) Appl. No.: 17/673,046

(22) Filed: Feb. 16, 2022

Related U.S. Application Data

(60) Provisional application No. 63/150,039, filed on Feb. 16, 2021.

(51) Int. Cl.
*A47K 5/12* (2006.01)
*A44C 5/00* (2006.01)

(52) U.S. Cl.
CPC ..... *A47K 5/1201* (2013.01); *A44C 5/003* (2013.01)

(58) Field of Classification Search
CPC ..... B65D 35/14; A44C 5/003; A47K 5/1201
See application file for complete search history.

(56) References Cited

U.S. PATENT DOCUMENTS 2,235,350 A * 3/1941 Anderson ..... A44C 15/002 63/3
2,543,408 A * 2/1951 Howell ..... A44C 5/22 63/3
3,160,323 A * 12/1964 Weisberg ..... B65D 35/247 138/119
3,260,412 A * 7/1966 Larkin ..... B65D 35/247 138/119
4,972,684 A * 11/1990 Aitken ..... A44C 15/002 63/7
5,217,143 A * 6/1993 Aitken ..... A44C 15/002 206/823
8,950,632 B2 * 2/2015 Ciavarella ..... A61L 9/12 224/148.2
9,110,498 B2 * 8/2015 Martinez ..... G06F 3/00
9,433,264 B2 * 9/2016 Ingimundarson .... A44C 5/0092
9,693,607 B2 * 7/2017 Imbriani ..... A44C 5/003
9,848,494 B2 * 12/2017 Huitema ..... H05K 1/0281
10,123,607 B1 * 11/2018 Hardy ..... A45D 40/261
10,146,261 B2 * 12/2018 Hashimoto ..... G06F 3/042
11,176,802 B1 * 11/2021 Robinson ..... G06F 1/163
11,304,570 B1 * 4/2022 Shaukat ..... A47K 5/1217
(Continued)

FOREIGN PATENT DOCUMENTS

CN 215024713 U * 12/2021
GB 2553500 A * 3/2018 ..... A44C 5/00
(Continued)

*Primary Examiner* — Timothy L Maust
(74) *Attorney, Agent, or Firm* — SMITH TEMPEL; Steven P. Wigmore

(57) ABSTRACT

A method and system provide a portable container for carrying hand sanitizer that may include a wearable wristband dispenser. The wristband dispenser may be made of a material which is flexible and has bistable spring bands. The wristband may have materials in common with slap bracelets or snap bracelets. The wristband dispenser may have a substantially linear geometry in a first position, and then it may have a substantially circular geometry after the wristband dispenser is "slapped" or "snapped" around wrist of a user.

10 Claims, 24 Drawing Sheets

(56) References Cited

U.S. PATENT DOCUMENTS

| | | | | |
|---|---|---|---|---|
| 2006/0219742 | A1* | 10/2006 | Chen | A45D 33/33<br>224/267 |
| 2011/0155765 | A1* | 6/2011 | Properzi | A47K 5/1201<br>222/401 |
| 2017/0156454 | A1* | 6/2017 | Abadi | A44C 5/0053 |
| 2021/0378456 | A1* | 12/2021 | Singer | A44C 5/0007 |
| 2022/0015583 | A1* | 1/2022 | Winn | A45F 5/00 |
| 2022/0024643 | A1* | 1/2022 | Saltzberg | B65D 35/26 |

FOREIGN PATENT DOCUMENTS

| | | | | |
|---|---|---|---|---|
| KR | 20080107843 | A * | 12/2008 | |
| WO | WO-2017077458 | A1 * | 5/2017 | A01M 29/12 |

* cited by examiner

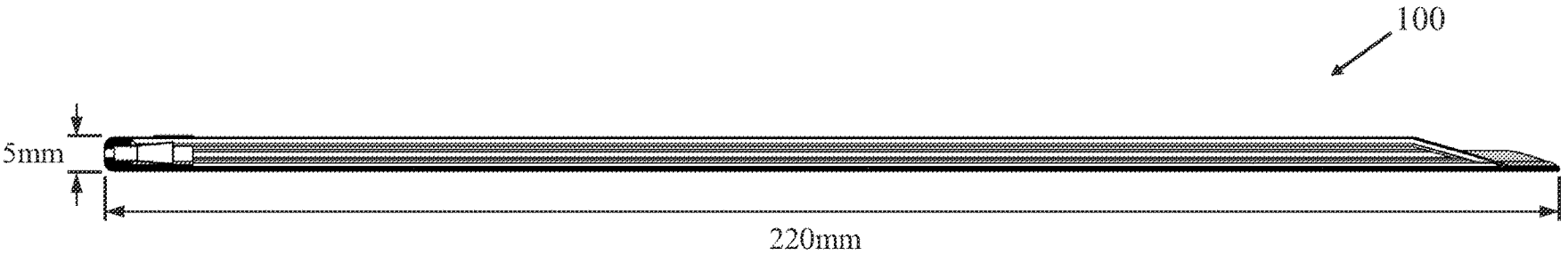
FIG. 12
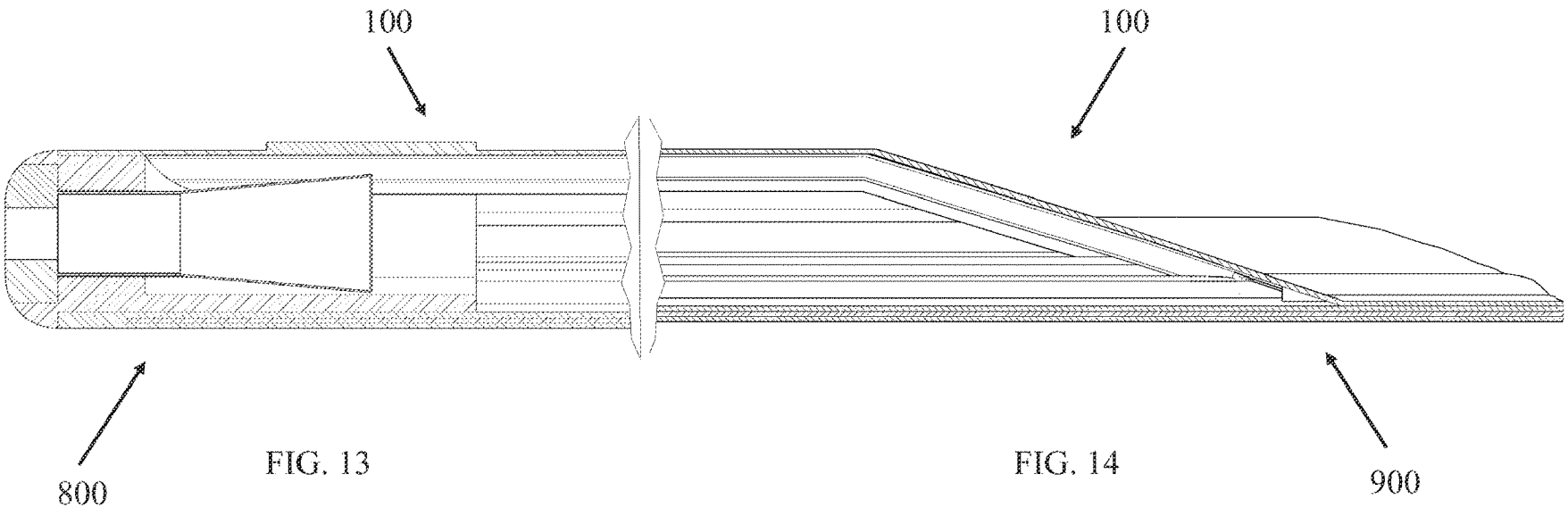
FIG. 14
FIG. 13

METHOD AND SYSTEM FOR PROVIDING A SELF-RETAINING WRISTBAND DISPENSER FOR LIQUIDS OR GELS

BACKGROUND

People often need hand sanitizer when people are exposed to objects and other people, especially after people touch other people and/or these objects. However, it can be problematic for a person to carry containers of hand sanitizer when on the move.

Currently, hand sanitizer manufacturers make very portable containers for carrying hand sanitizer. While these portable containers are often small, such as holding liquid volumes on the order of one to two fluid ounces of hand sanitizer, these portable containers still must be carried on a person by putting the container in a pocket or in a purse or in a suitcase.

One problem with these portable containers is that they can be easily lost or misplaced by a person since he or she must carry it on their person in a separate pouch, bag, or carry-on as described above. Also refilling the portable containers is cumbersome and not user friendly making a rapid replacement of hand sanitizer not very user-friendly.

Another problem with the small portable containers is that they often require the user to squeeze and chase the hand sanitizer repeatedly towards the opening in a container. During non-use, the hand sanitizer in these portable containers redistributes, forcing the user to hunt for the hand sanitizer again on the next use.

Thus, there is a need in the art for a more portable and practical way to transport hand sanitizing fluids and/or gels which are not easily lost and which may solve the problem of reducing additional objects for carrying the portable containers of hand sanitizer.

SUMMARY

A method and system provides for a portable container for carrying hand sanitizer that may comprise a wearable wristband dispenser. The wristband dispenser may comprise a material which is flexible and has bistable spring bands. The wristband may have materials in common with slap bracelets or snap bracelets known as of this writing. The wristband dispenser may comprise a substantially linear geometry in a first position, and then it may comprise a substantially circular geometry after the wristband dispenser is "slapped" or "snapped" around wrist of a user.

The wristband dispenser may comprise at least a button and valve coupled to a container disposed within the wristband. The valve may be opened by the button 310 in order to release a liquid or gel, from the container.

The wristband dispenser may be manufactured in two different manufacturing environments: one that is a "High Volume"/high speed manufacturing environment and one that is a "Medium Volume"/medium speed manufacturing environment. For the High Volume embodiment, this version may be made from a thin film compostable plastic.

For the "Medium Volume" version of the wristband dispenser, this one may be made from silicon injection molding techniques. And by shipping both the High Volume and Medium Volume wristbands from the factory/manufacture in a straight configuration (not the "slap/wrist" circular configuration), this straight configuration improves the wristband packaging where nesting of bands may be provided to improve their transport.

The wristband dispenser also improves distribution of the contained fluid: the hand sanitizer may be distributed across almost the entire circumference of the band. Also the minimal design of the wristband creates a lot of surface area for printed advertising on the band (i.e. logos, text, brands, etc.).

Re-filling of the High Volume embodiment of the wristband dispenser is made convenient for the compostable plant based polymer film design by sliding a metal band out of the double sleeve and inserting into new prefilled hand sanitizer pouch with double sleeve. This feature may be referred to as "The disposable package," for the High Volume embodiment/version.

For the Medium Volume embodiment of the wristband dispenser, this version may be made from silicone injection molding techniques as understood by one of ordinary skill in the art. The silicone used may be durable for multiple uses and refills. For this embodiment, the wristband may be filled at a dispenser station compatible with interfacing and sealing with the wrist-band dispenser outlet. Typical round dispenser bottles filled with hand sanitizer will not seal to the flat wristband dispenser outlet in order to re-fill from a bottle.

This summary is provided to introduce a selection of concepts that are further described below in the detailed description and illustrated in the several detailed figures. This summary is not intended to identify key or essential features of the claimed subject matter, nor is it intended to be used as an aid in limiting the scope of the claimed subject matter.

BRIEF DESCRIPTION OF THE DRAWINGS

FIG. 12 Illustrates a cross sectional view of wrist band of FIG. 11.

FIG. 13 Illustrates a close up view of the dispenser end of wrist band of FIG. 12.

FIG. 14 Illustrates a close up view of the non-dispenser end of wrist band of FIG. 12.

DETAILED DESCRIPTION OF EXEMPLARY EMBODIMENTS

Figure 1:
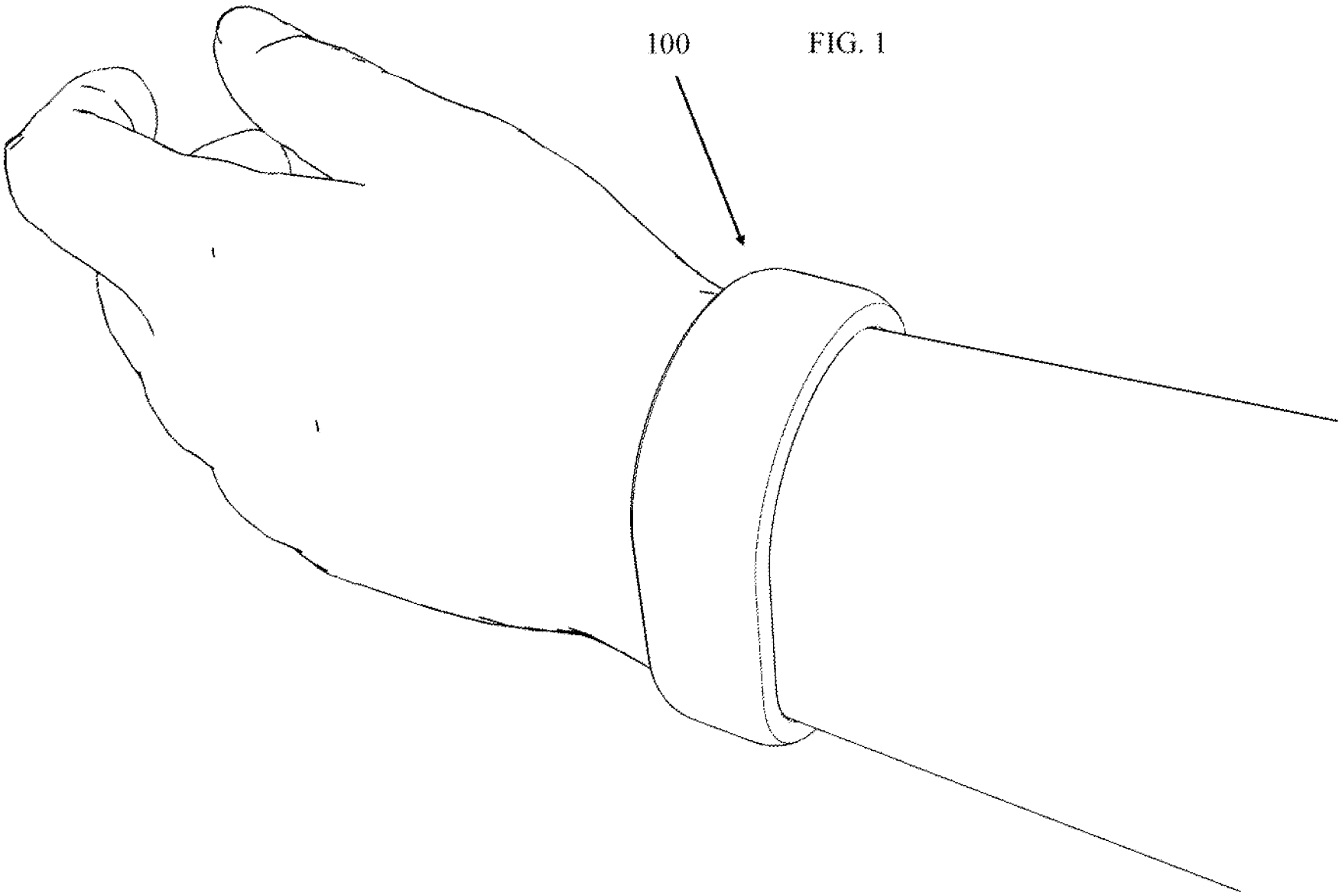
FIG. 1 Illustrates a perspective view of a wristband worn according to the present invention.

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures. For clarity, not all components are shown in each Figure.

All components disclosed may be designed for sheet metal stamping or injection molding processes. Other manufacturing methods are also possible, and are included within the scope of this disclosure. Other methods include, but are not limited to, rolling, molding, blown film extrusion, slitting, seam or ultrasonic or laser welding, precision guillotine or dye cutting, etc. as understood by one of ordinary skill in the art.

The word "exemplary" is used herein to mean "serving as an example, instance, or illustration." Any aspect described herein as "exemplary" is not necessarily to be construed as exclusive, preferred or advantageous over other aspects.

Figure 2:
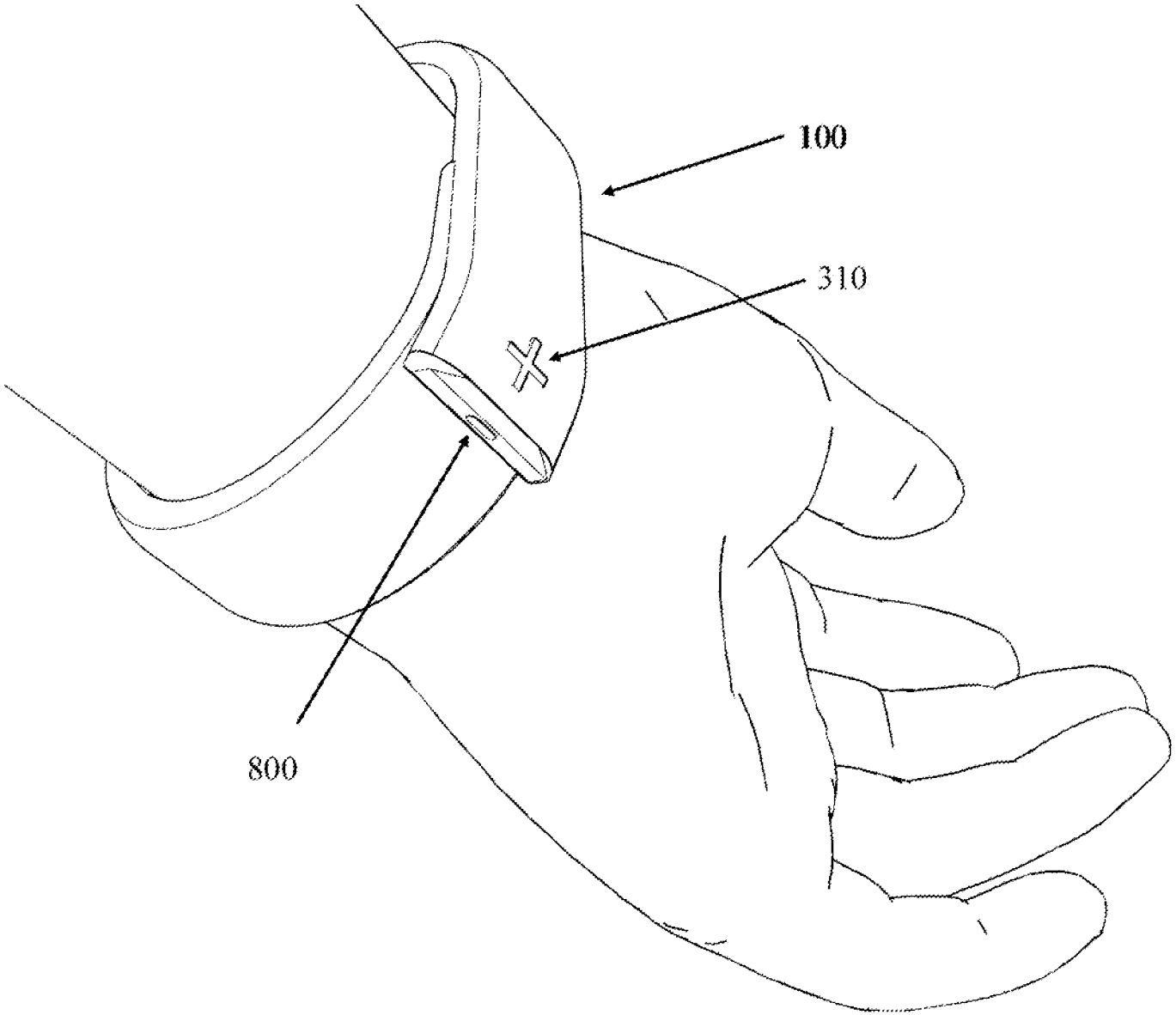
FIG. 2 Illustrates a dispenser on the palm side perspective of FIG. 1.

FIG. 1 Illustrates a perspective view of a wristband 100 worn according to the present invention. Referring now to FIG. 2, this figure Illustrates a palm side perspective of FIG. 1 of a dispenser end 800 and a dispenser button 310 of a wristband 100 worn according to the present invention.

Figure 3:
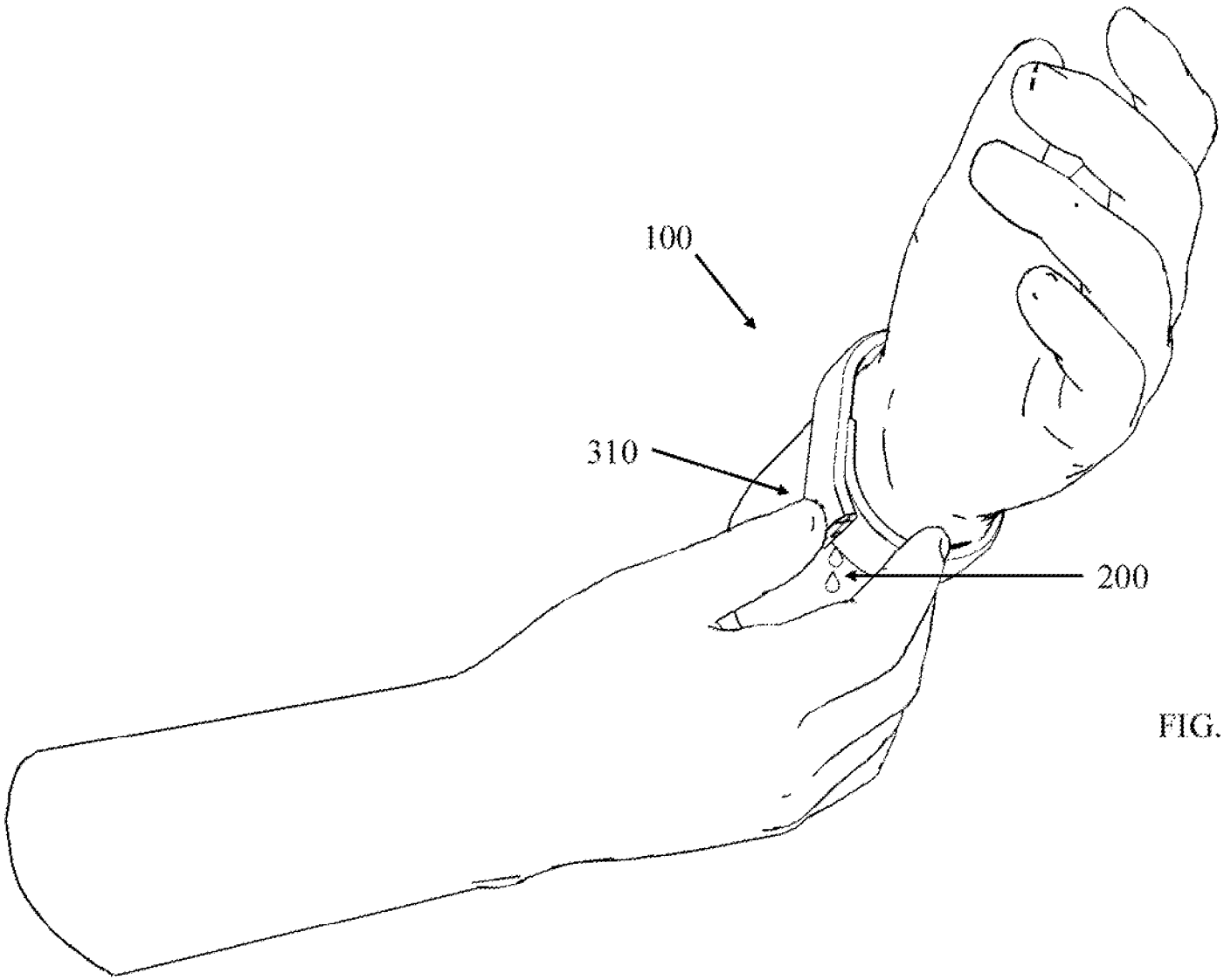
FIG. 3 Illustrates a general perspective of activating the dispenser of FIG. 2.
Figure 4:
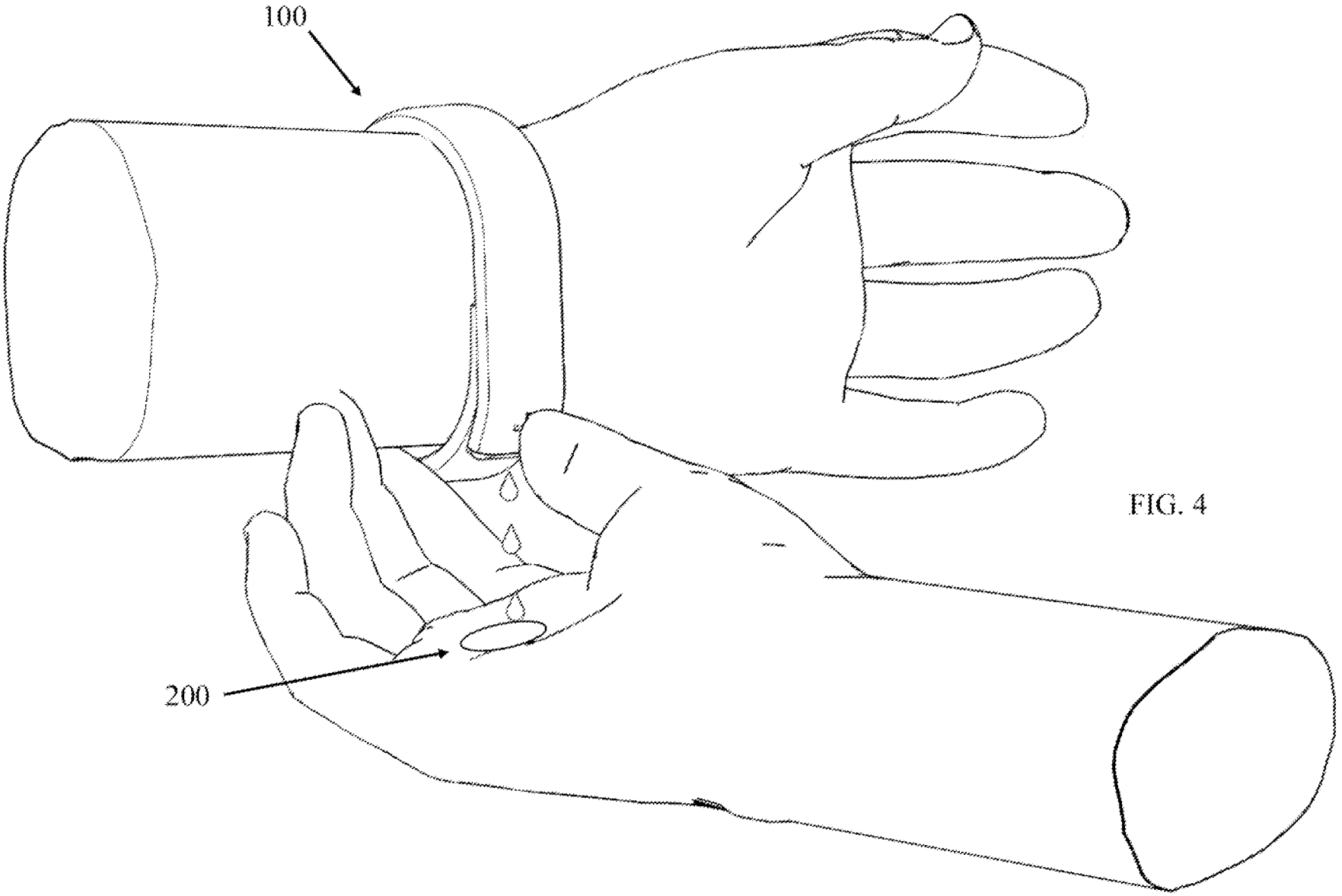
FIG. 4 Illustrates a general perspective of FIG. 3 dispensing liquid or gel into the palm of a hand.

FIG. 3 Illustrates a general perspective of activating an exemplary dispenser button 310 of FIG. 2. and releasing fluid or gel-based hand sanitizer 200 from an exemplary wristband dispenser 100 FIG. 4 Illustrates a general perspective of FIG. 3 dispensing fluid or gel 200 into a palm of a hand.

Figure 5:
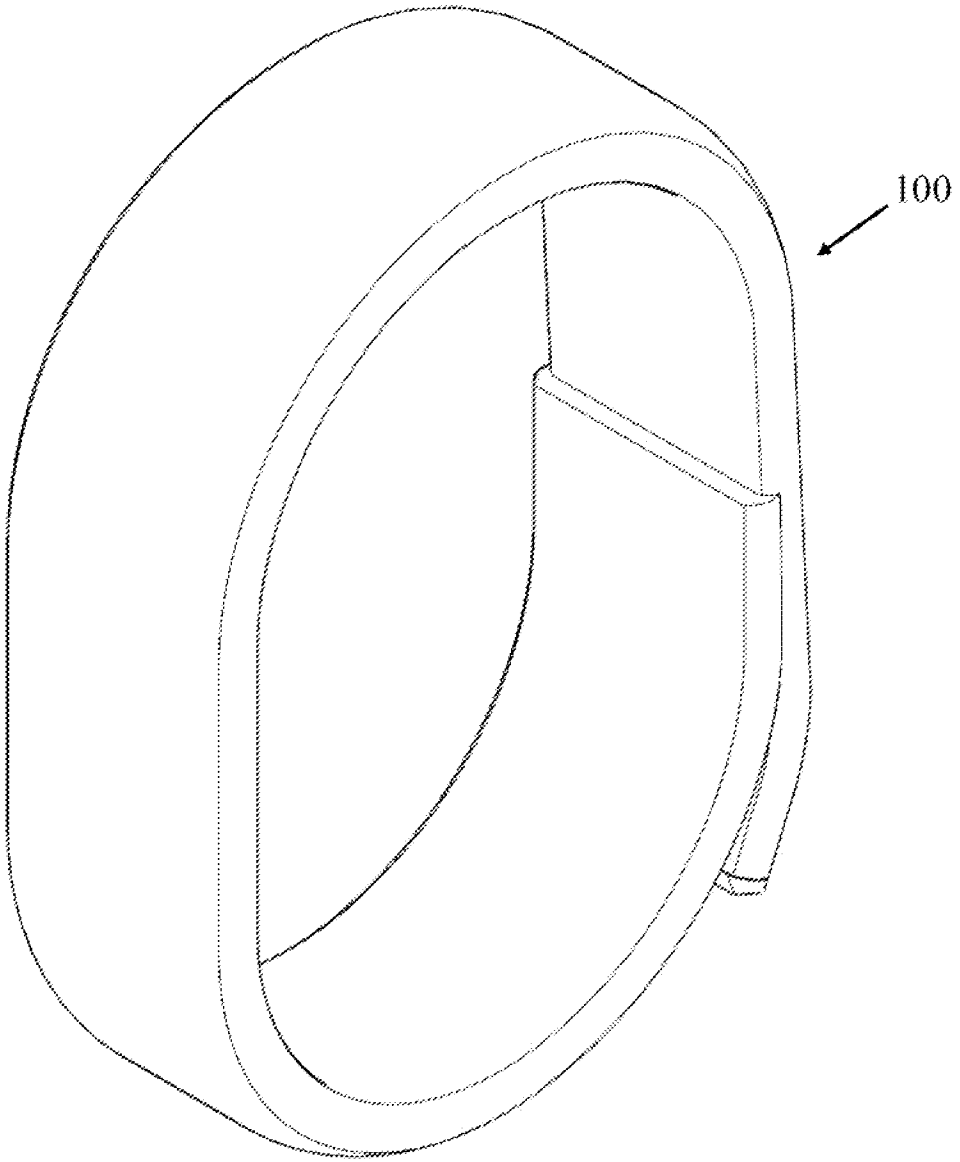
FIG. 5 Illustrates an isometric view of FIG. 1 without the hand shown.
Figure 6:
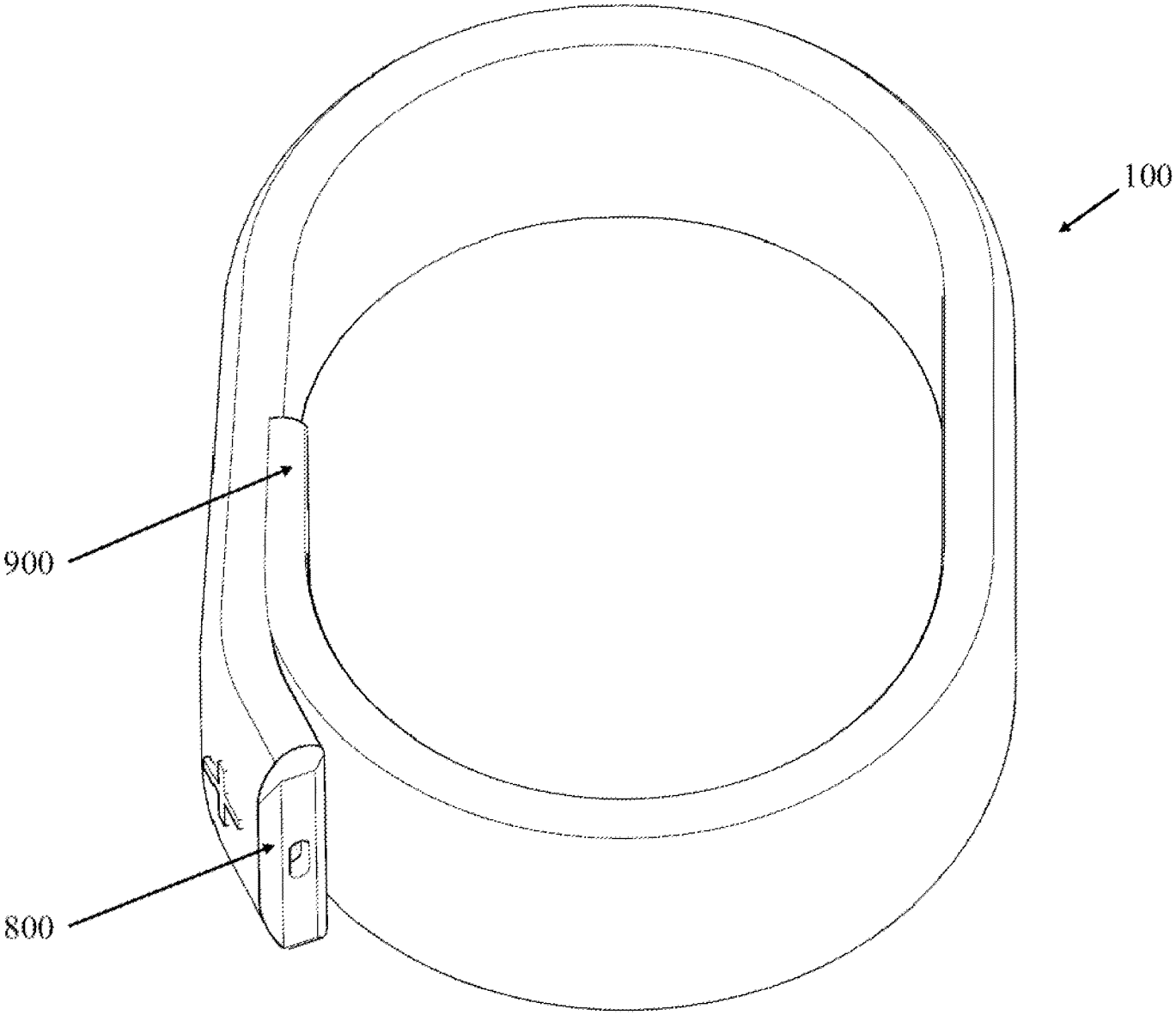
FIG. 6 Illustrates a bottom view of a symmetrical wristband of FIG. 5 without the hand shown.

FIG. 5 Illustrates an isometric view of an exemplary wristband 100 of FIG. 1, without the hand shown. FIG. 6 Illustrates a bottom view of a symmetrical wristband 100, an exemplary dispenser end 800 and an exemplary non-dispenser end 900 of FIG. 5 without the hand shown.

Figure 7:
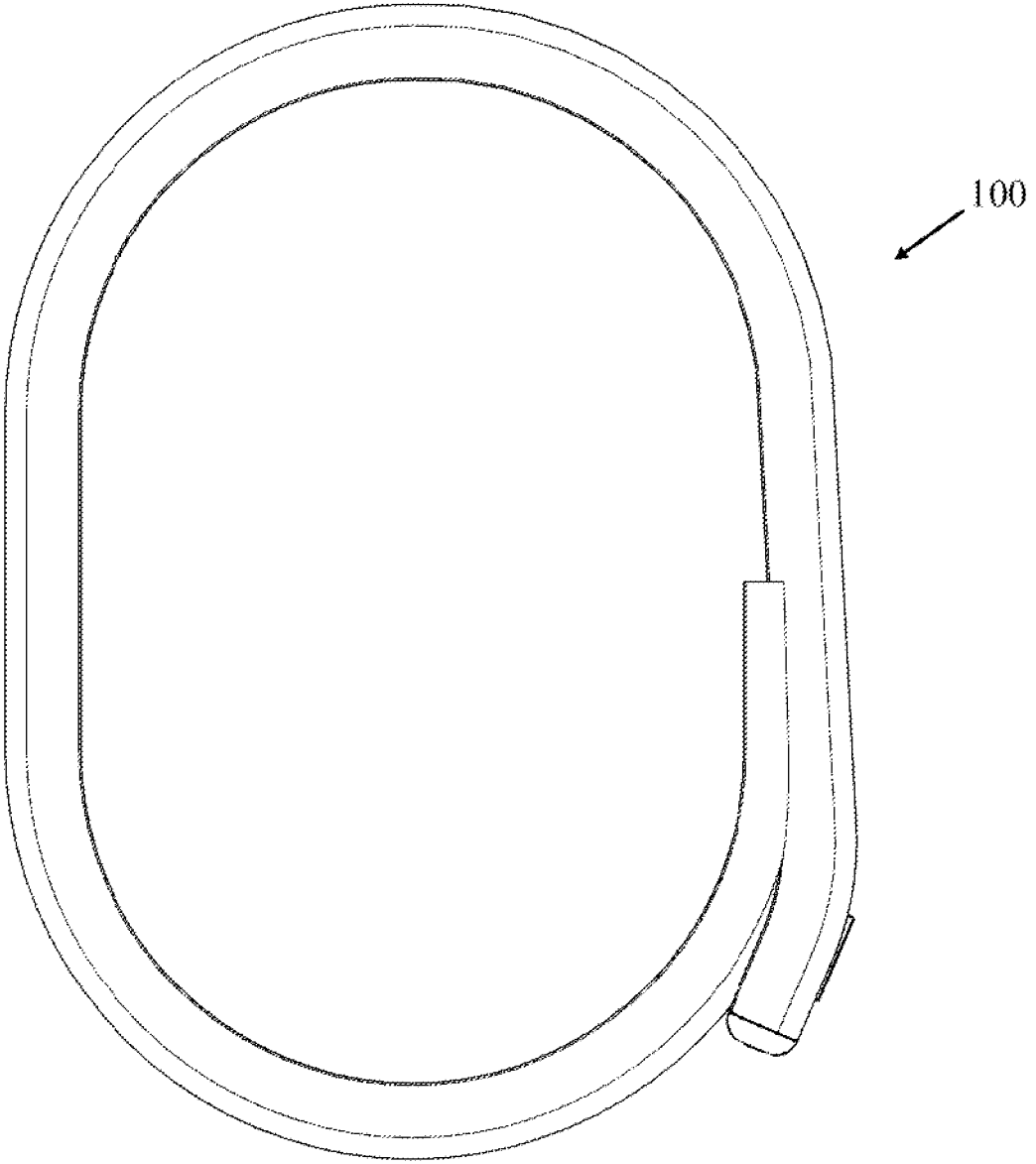
FIG. 7 Illustrates a left side view of wrist band of FIG. 6.
Figure 8:
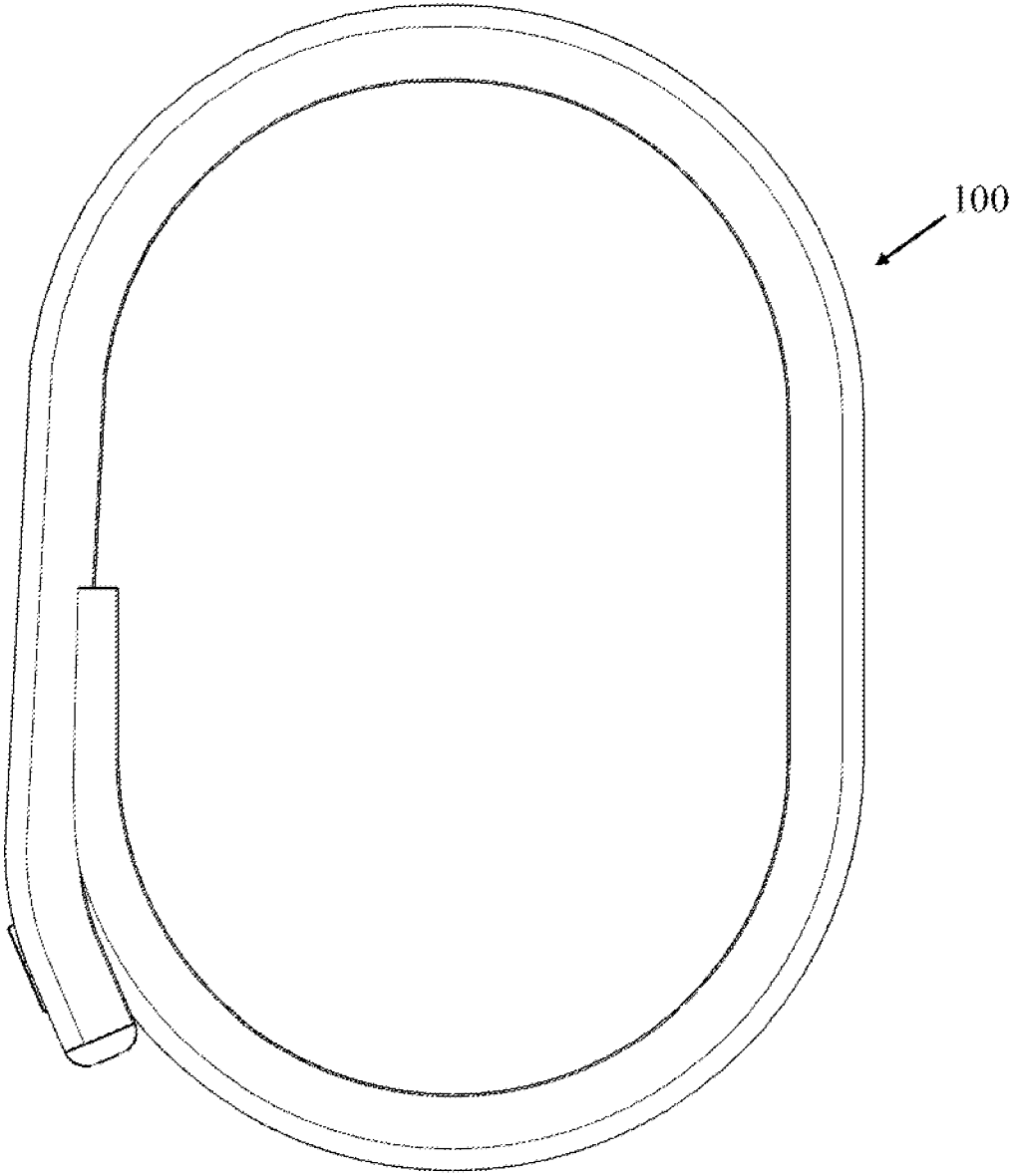
FIG. 8 Illustrates a right side view of wrist band of FIG. 7.
Figure 9:
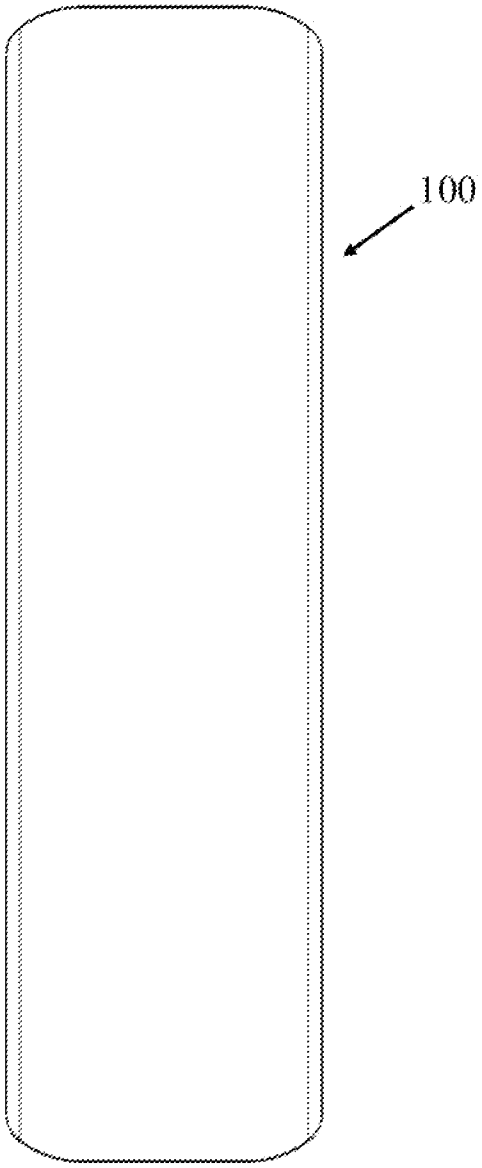
FIG. 9 Illustrates a front view of wrist band of FIG. 8.

FIG. 7 Illustrates a left side view of a exemplary wrist band 100 of FIG. 6. while FIG. 8 Illustrates a right side view of a exemplary wrist band 100 of FIG. 7. And FIG. 9 Illustrates a front view of the exemplary wrist band 100 of FIG. 8.

Figure 10:
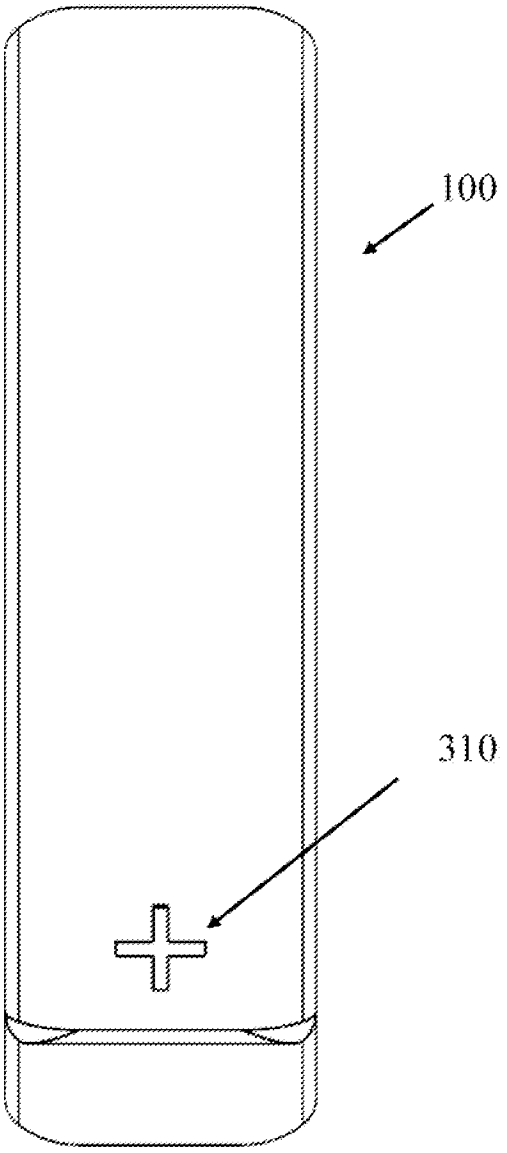
FIG. 10 Illustrates a rear view of wrist band of FIG. 9.
Figure 11:
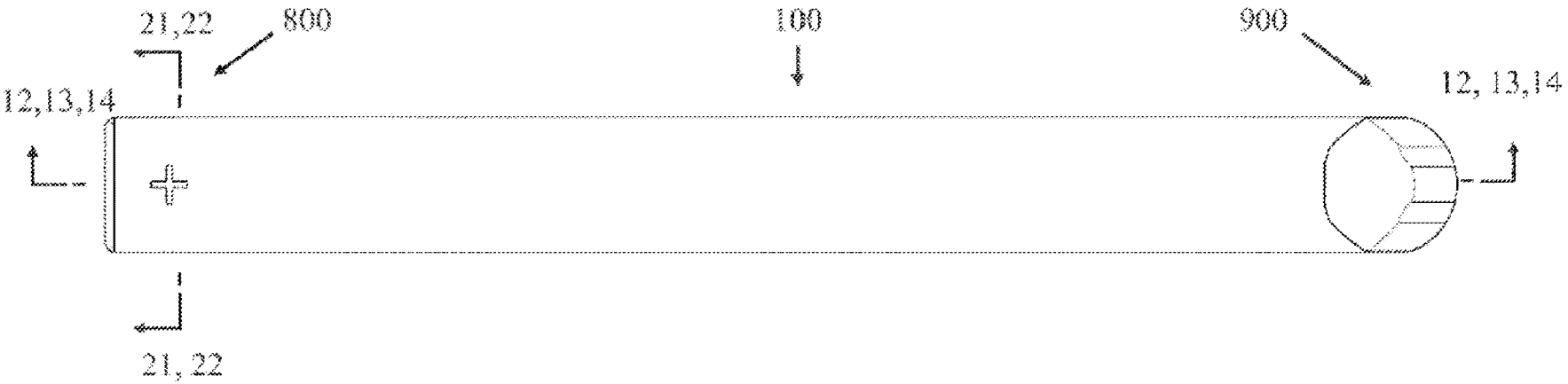
FIG. 11 Illustrates a top view of wrist band in a straight form of FIG. 10.

FIG. 10 Illustrates a rear view of the exemplary wrist band 100 and exemplary dispenser button 310 of FIG. 6. FIG. 11 Illustrates a top view of the exemplary wrist band 100, the dispenser end 800 and non-dispenser end 900 in a straight form of FIG. 10.

FIG. 12 Illustrates a cross sectional view with overall thickness and length reference dimensions of an exemplary wrist band 100 of FIG. 11. FIG. 13 Illustrates a close up view of the dispenser end 800 of wrist band of FIG. 12. FIG. 14 Illustrates a close up view of the non-dispenser end 900 of wrist band of FIG. 12.

Figure 15:
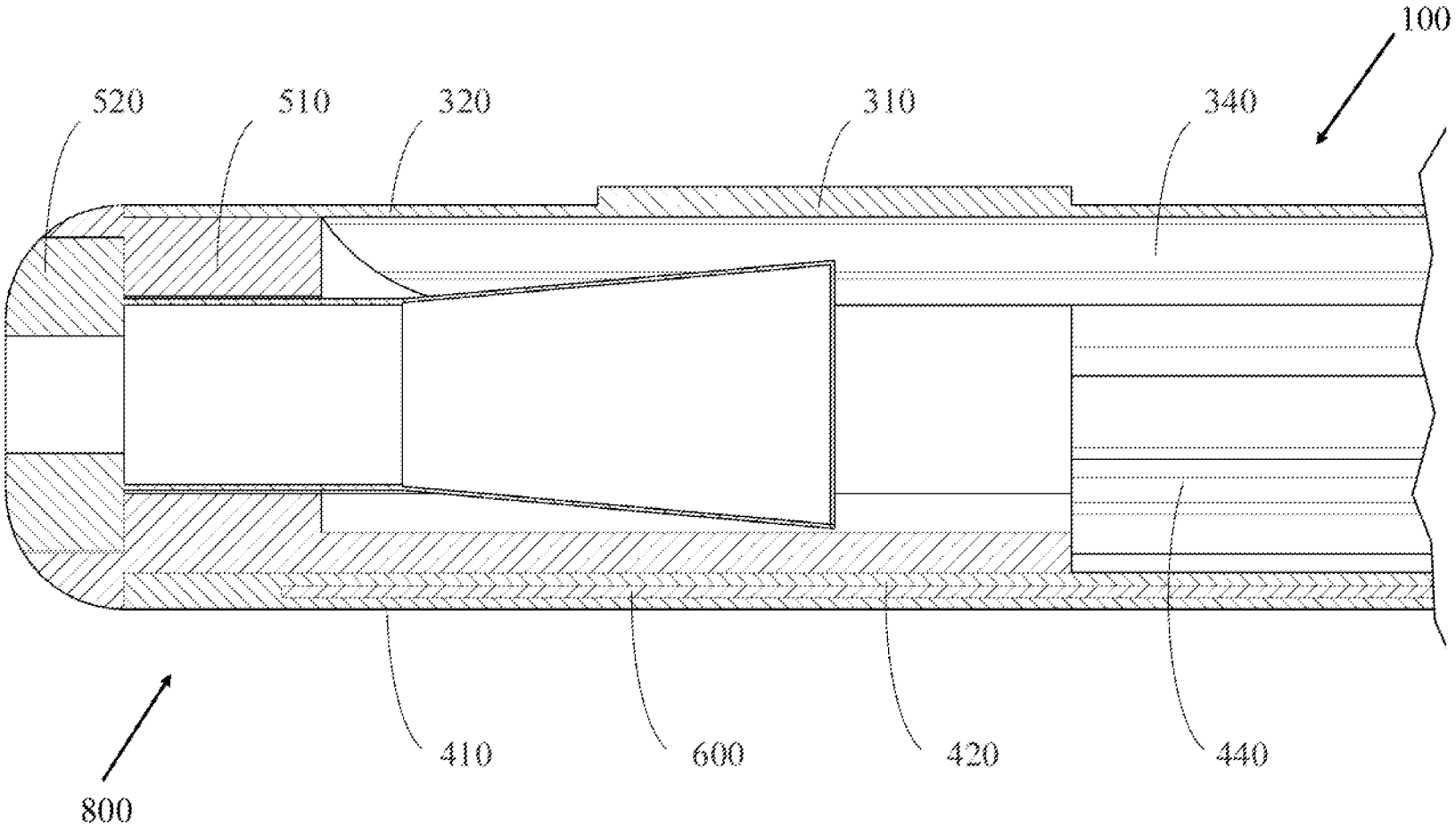
FIG. 15 Illustrates a view of the main components of dispenser end of wrist band of FIG. 13.

FIG. 15 Illustrates a cross-sectional close-up view of the main components, duckbill valve 520, duckbill housing 510, upper outer sleeve half 320, bottom outer sleeve half 410, bottom inner sleeve half 420, flat spring 600, dispenser button 310, upper right zipper half 340, lower right zipper half 440 of a dispenser end 800 of the exemplary wrist band 100 of FIG. 13.

Figure 16:
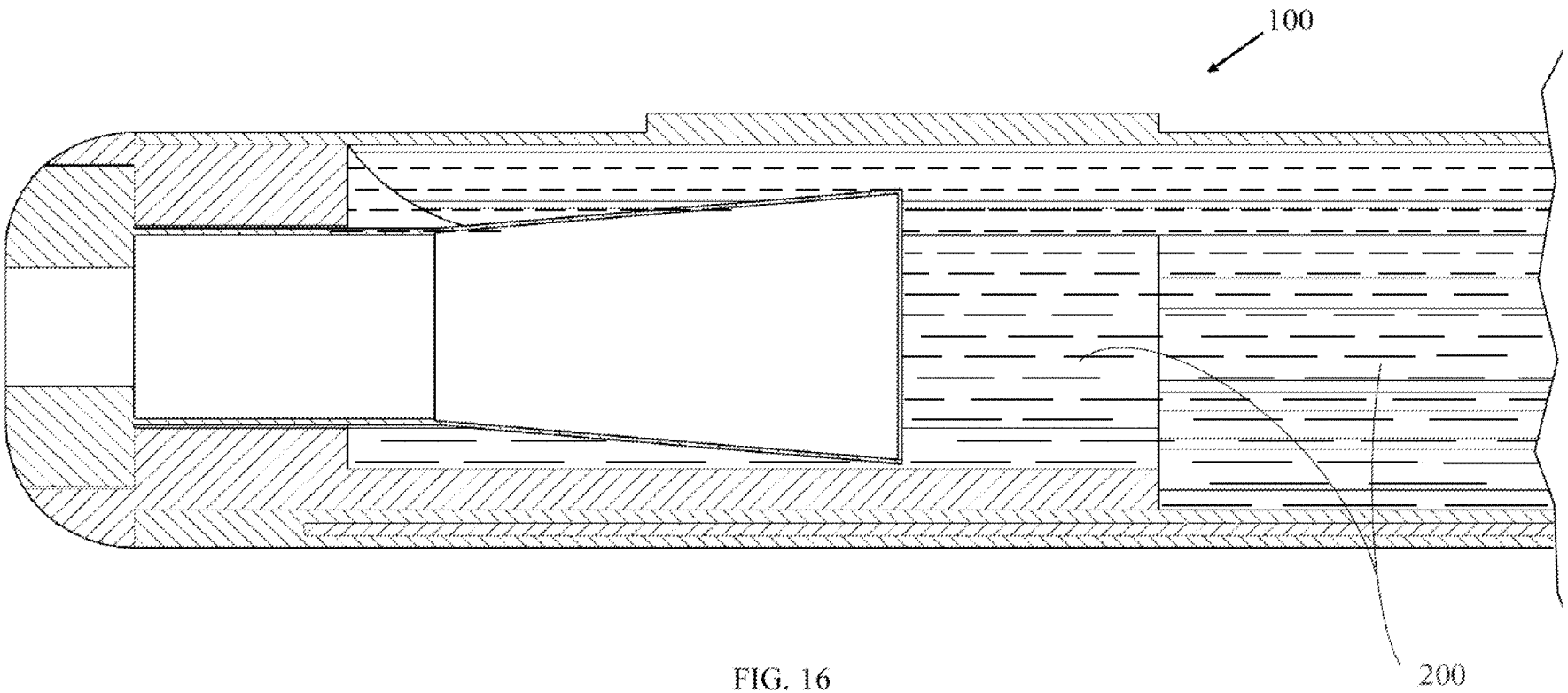
FIG. 16 Illustrates a close up view of the dispenser end of wrist band of FIG. 13 showing liquid or gel.
Figure 17:
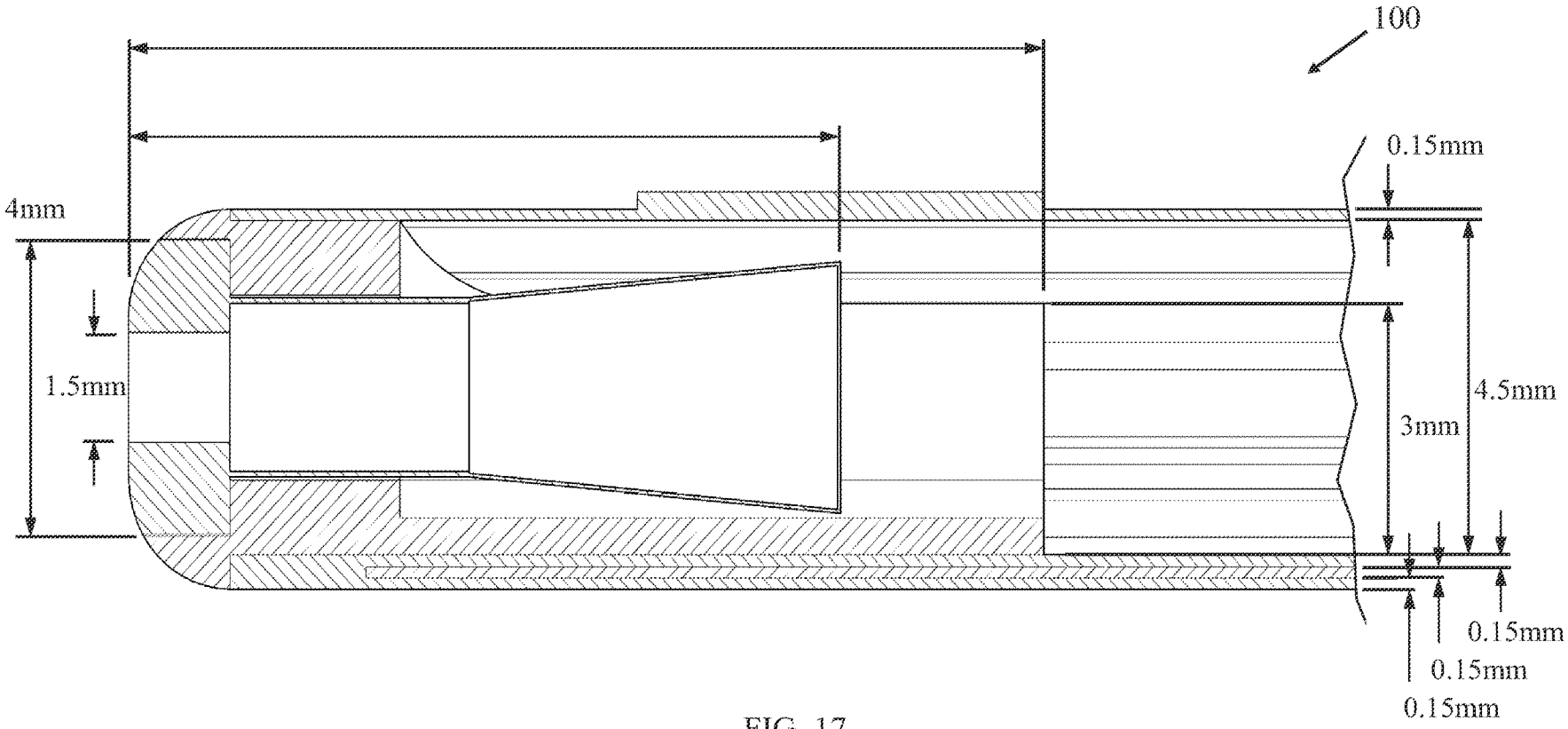
FIG. 17 Illustrates a view containing dimensions of wrist band of FIG. 13.
Figure 18:
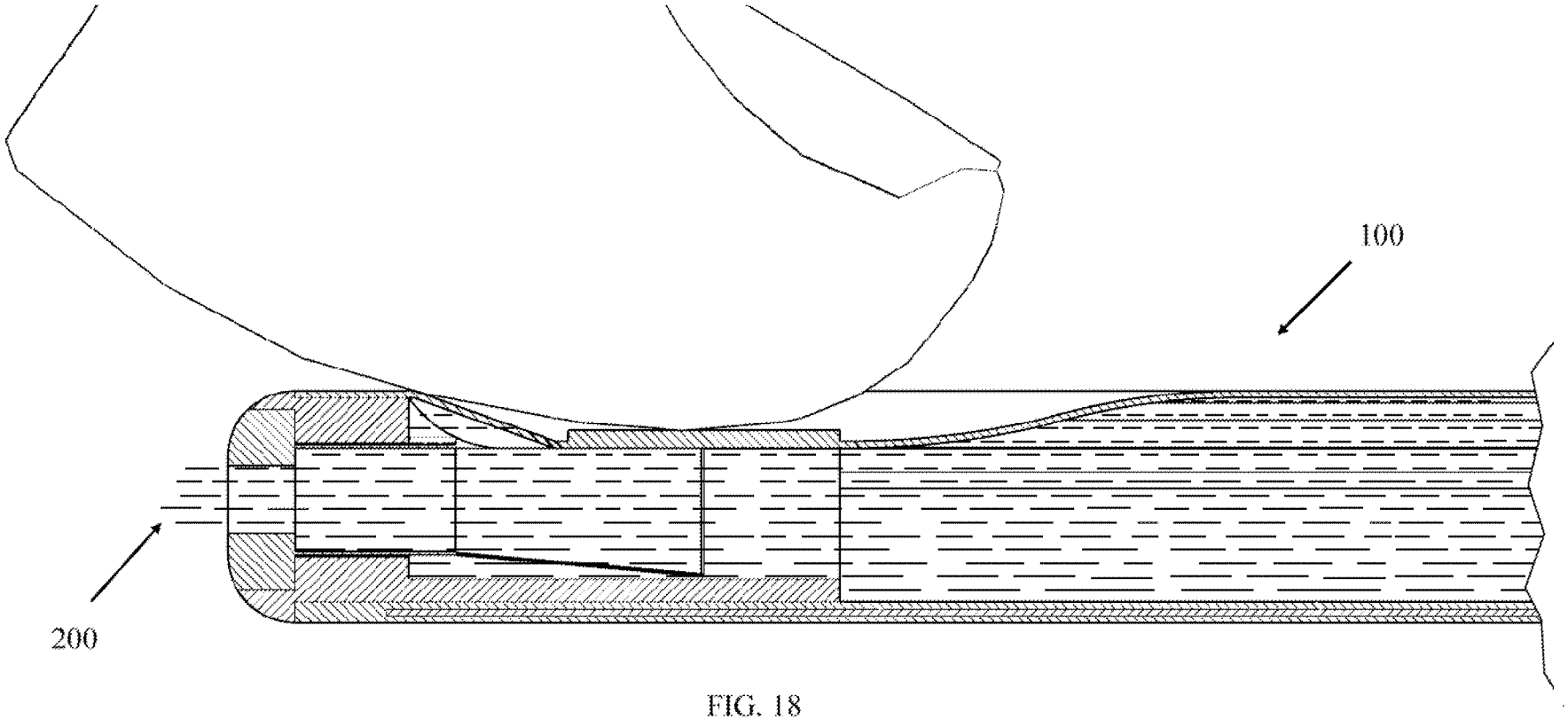
FIG. 18 Illustrates a view of a thumb activating the dispenser of wrist band of FIG. 16.

FIG. 16 Illustrates a close-up cross-sectional view of the dispenser end 800 showing liquid or gel 200 of a exemplary wrist band 100 of FIG. 13. FIG. 17 Illustrates a close-up cross-sectional view containing reference dimensions of the exemplary wrist band 100 of FIG. 13. FIG. 18 Illustrates a view of a thumb activating the dispenser button 310 and dispensing fluid or gel 200 of a exemplary wrist band 100 of FIG. 16.

Figure 19:
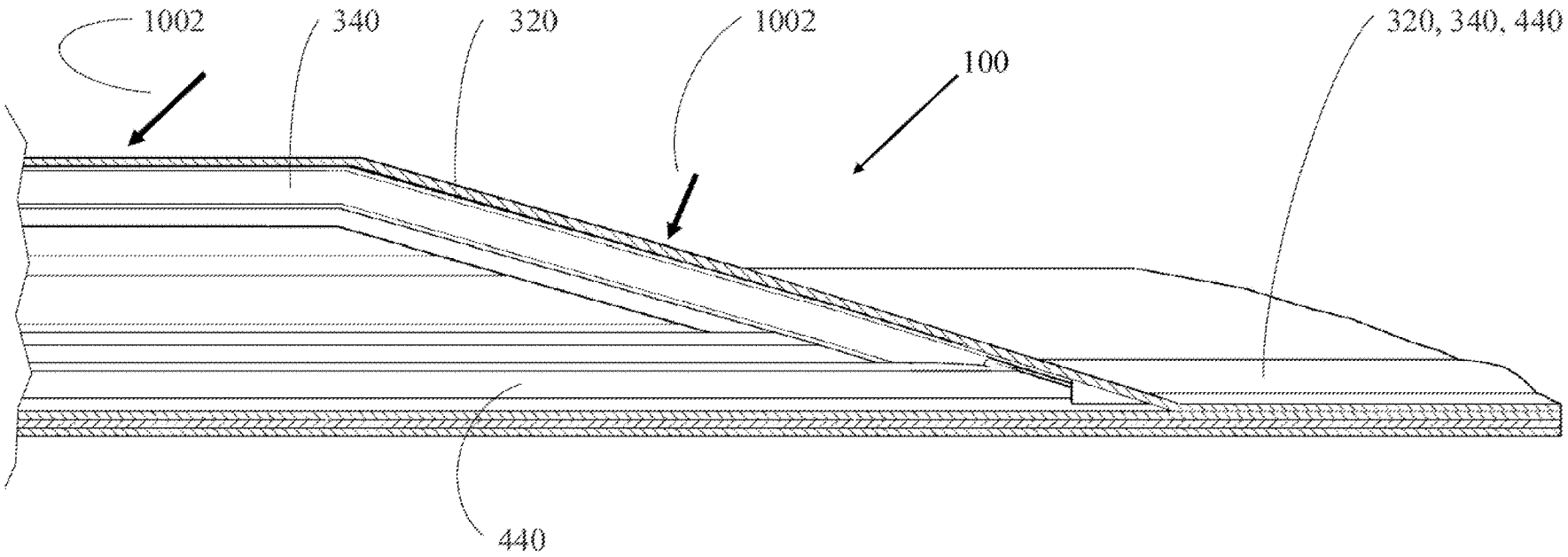
FIG. 19 Illustrates a view of the main components of the non-dispenser end of wrist band of FIG. 14.

FIG. 19 Illustrates a view of the main components, upper right zipper half 340, lower right zipper half 440 and upper outer sleeve half 320, of a heat sealed non-dispenser end 900 of the exemplary wrist band 100 of FIG. 14. Travel direction 1002 of applied force to close upper right zipper half 340 and lower right zipper half 440 is also shown.

Figure 20:
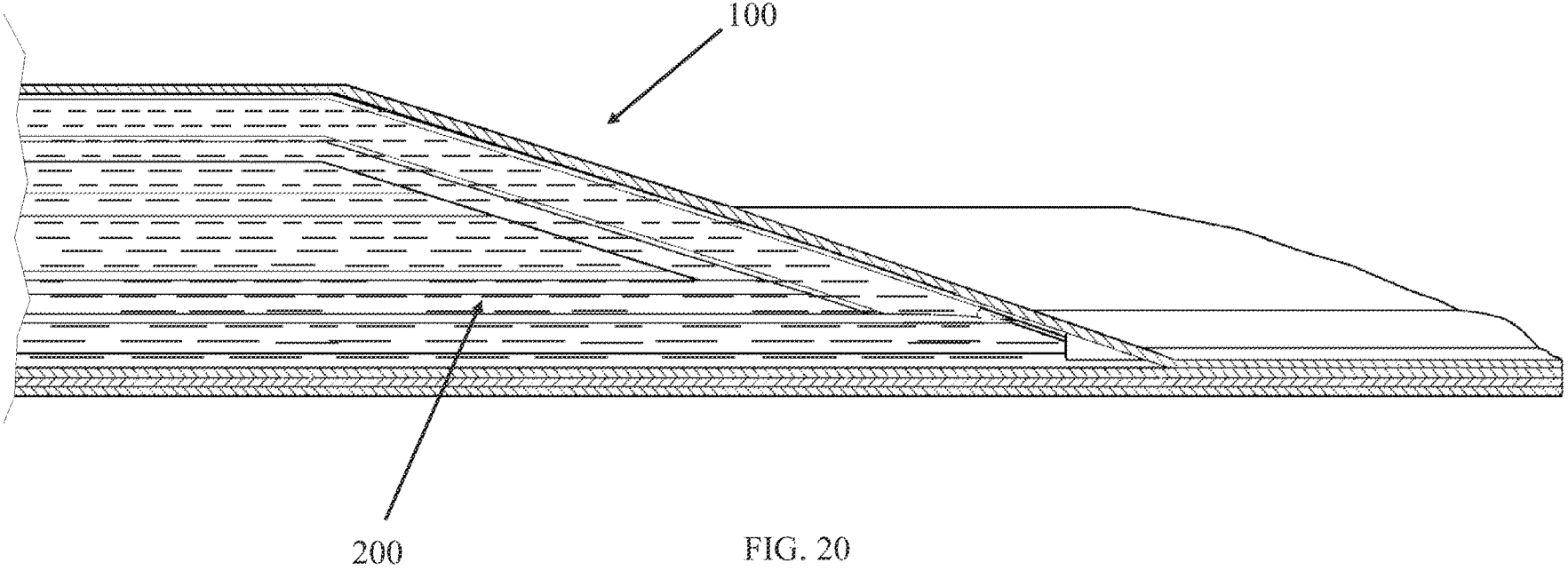
FIG. 20 Illustrates a close up view of the non-dispenser end of wrist band of FIG. 14 showing liquid or gel.
Figure 21:
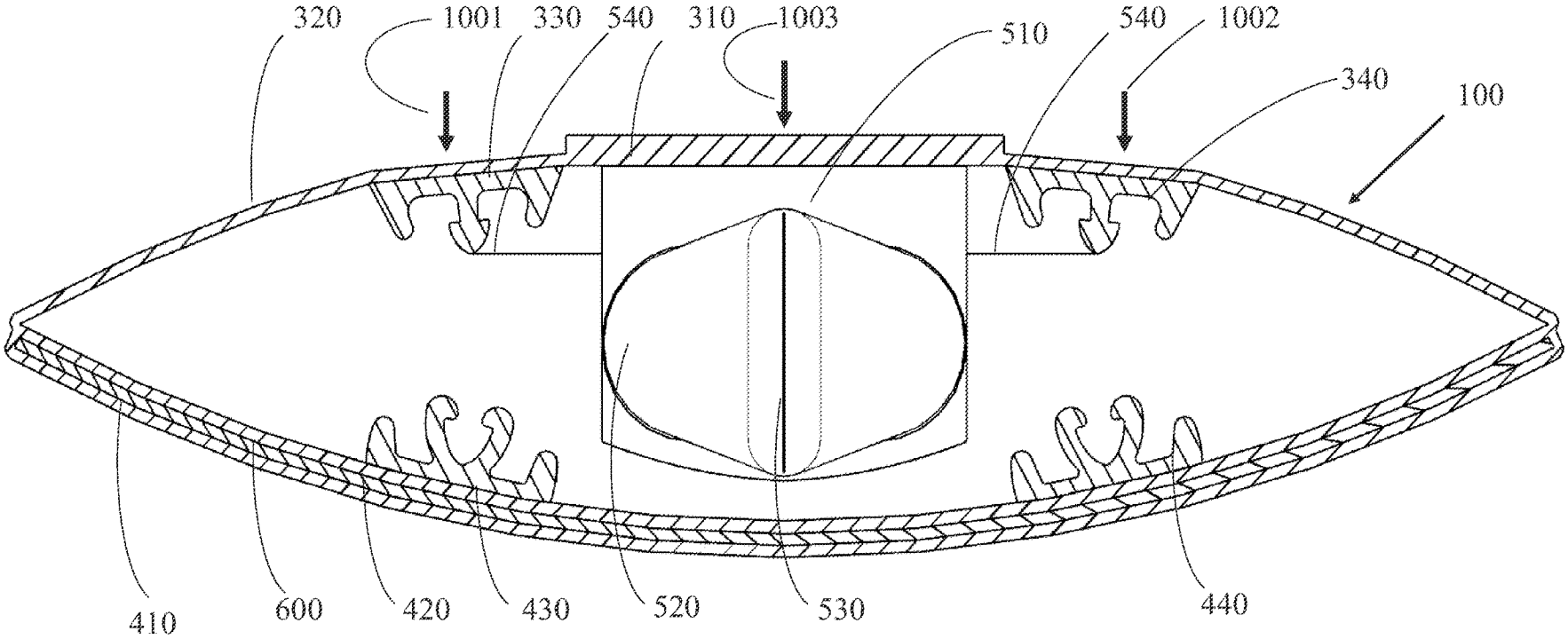
FIG. 21 Illustrates a cross sectional view showing main components of dispenser end of wrist band of FIG. 11.

FIG. 20 Illustrates a close up cross sectional view of the non-dispenser end 900 of a exemplary wrist band 100 of FIG. 14 showing liquid or gel 200. FIG. 21 Illustrates a cross sectional view showing main components, upper outer sleeve 320, upper left zipper half 330, dispenser button 310, duckbill valve housing shoulder limit 540, upper right zipper half 340, bottom outer sleeve 410, flat spring 600, bottom inner sleeve half 420, lower left zipper half 430, duckbill valve 520, duckbill valve slit 530 and lower right zipper half 440, looking from dispenser end 900 of wrist band 100 of FIG. 11. Travel direction 1001 and 1002 of applied force to close upper right zipper half 340, lower right zipper half 440, upper left zipper half 330 and lower left zipper half 430 is also shown.

Figure 22:
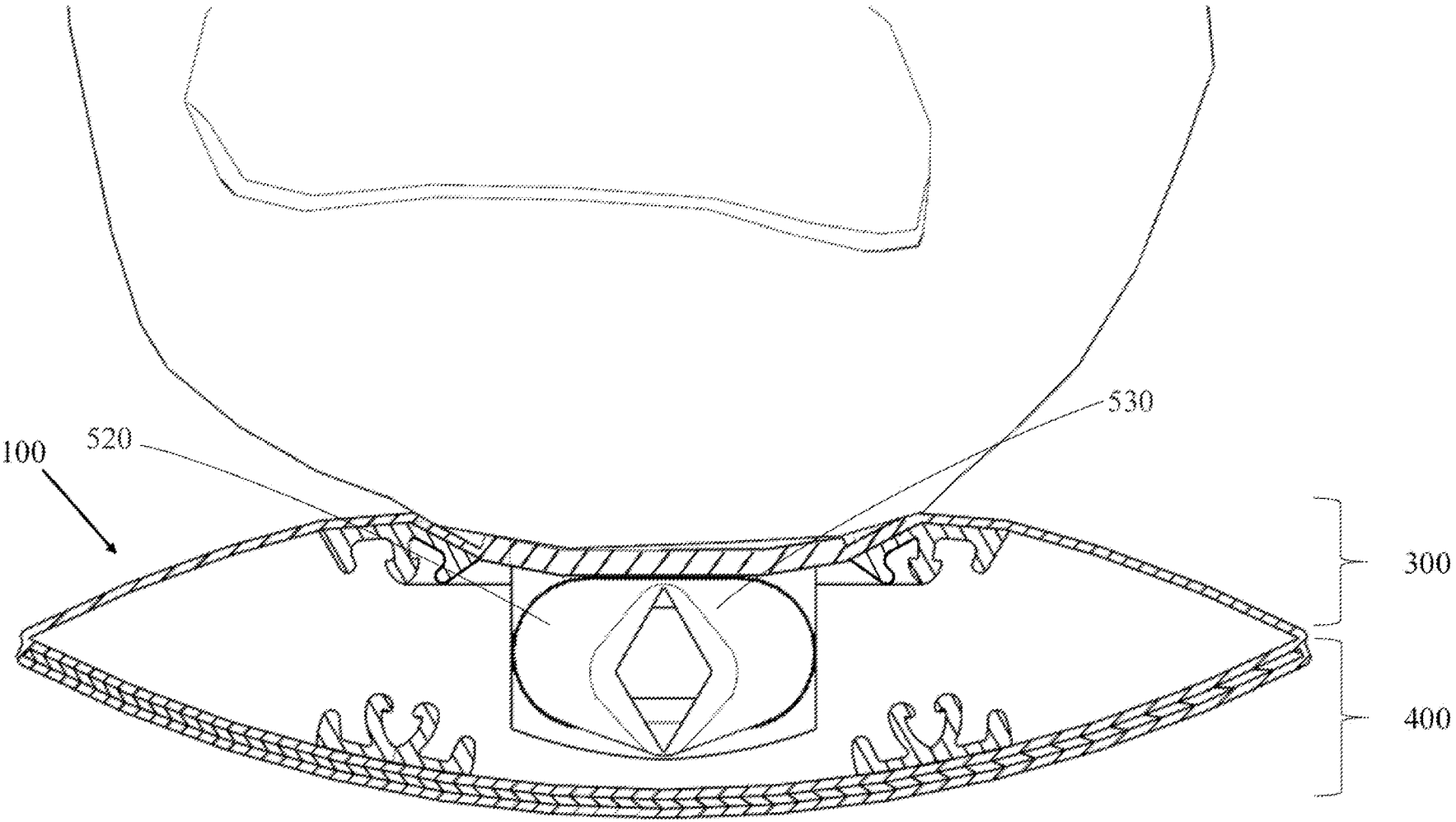
FIG. 22 Illustrates a view of a thumb activating the dispenser of wrist band of FIG. 21.
Figure 23:
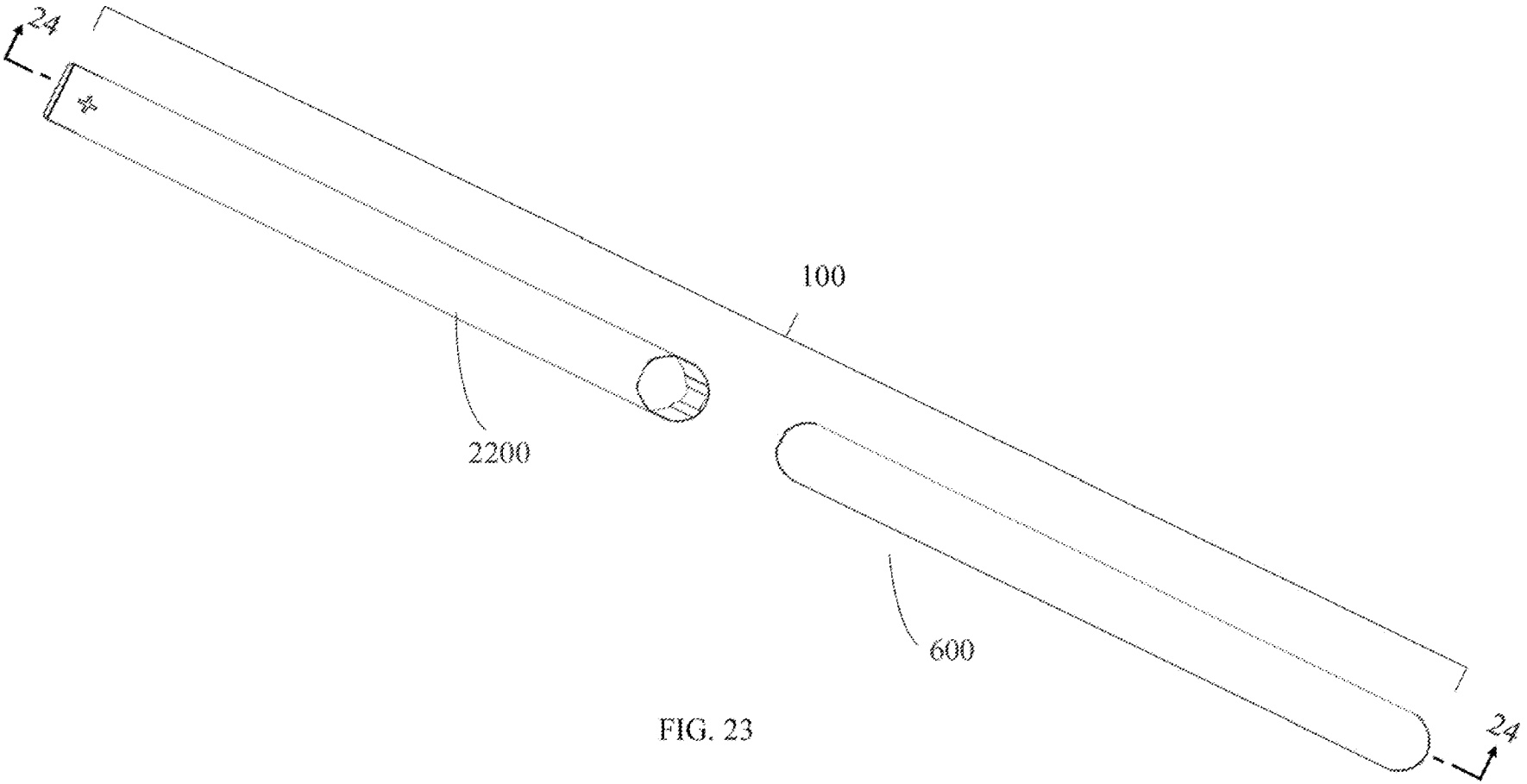
FIG. 23 Illustrates a generalized diagram of a top view of Inserting a flat spring into pouch of a mass production version of wrist band of FIG. 11.
Figure 24:
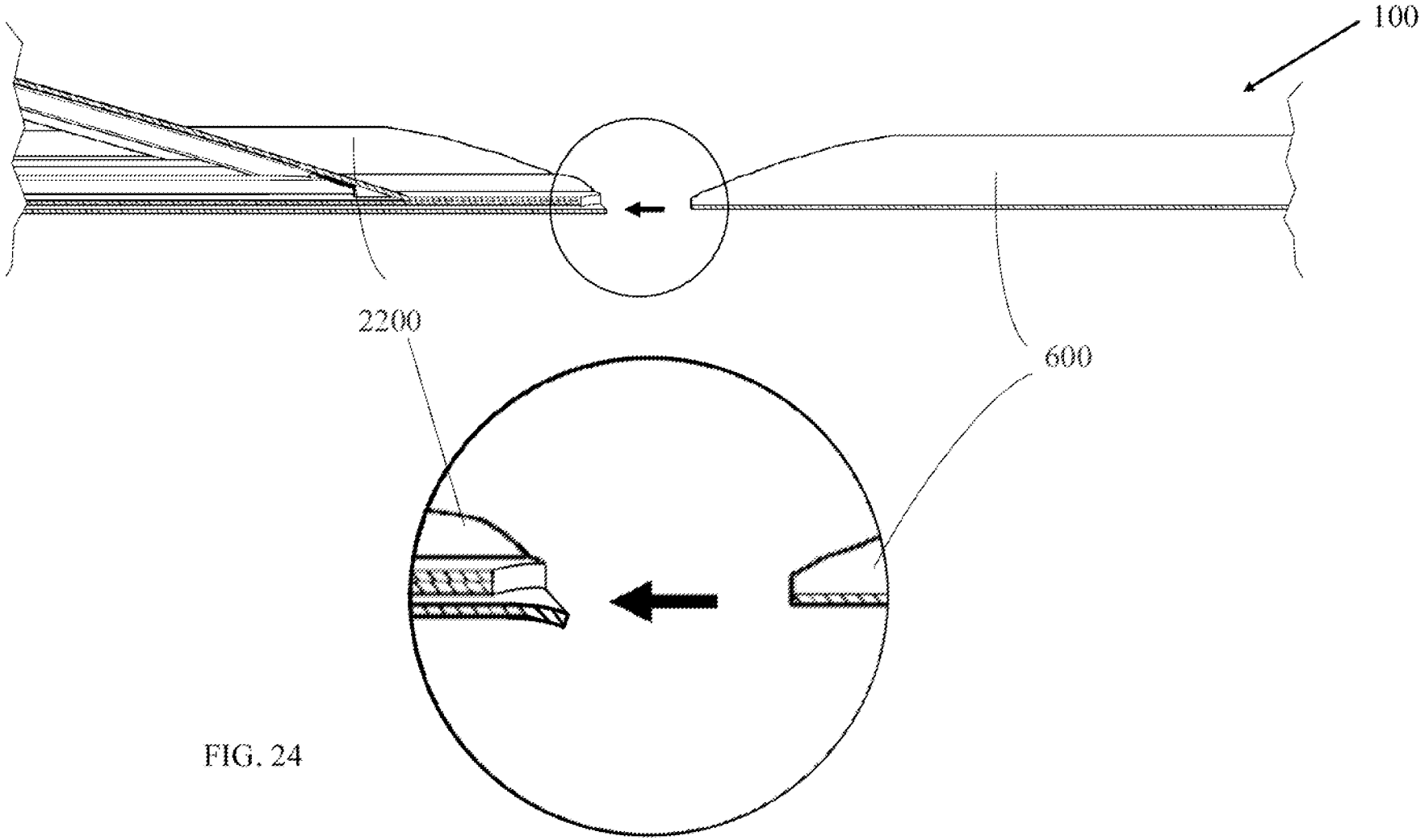
FIG. 24 Illustrates a side cross sectional view of Inserting a flat spring into pouch of a mass production version of wrist band of FIG. 11.

FIG. 22 Illustrates a view of a thumb activating the dispenser button 310 pushing open duck bill valve slit 530 within duck bill valve 520 of wrist band 100 of FIG. 21. Upper half 300 and lower half 400 is also shown. FIG. 23 Illustrates a generalized diagram of a top view of Inserting a flat spring 600 into disposable pouch 2200 of a mass production version of wrist band 100 of FIG. 11. FIG. 24 Illustrates a side cross sectional view of Inserting a flat spring into disposable pouch 2200 of a mass production version of wrist band 100 of FIG. 11.

Figure 26:
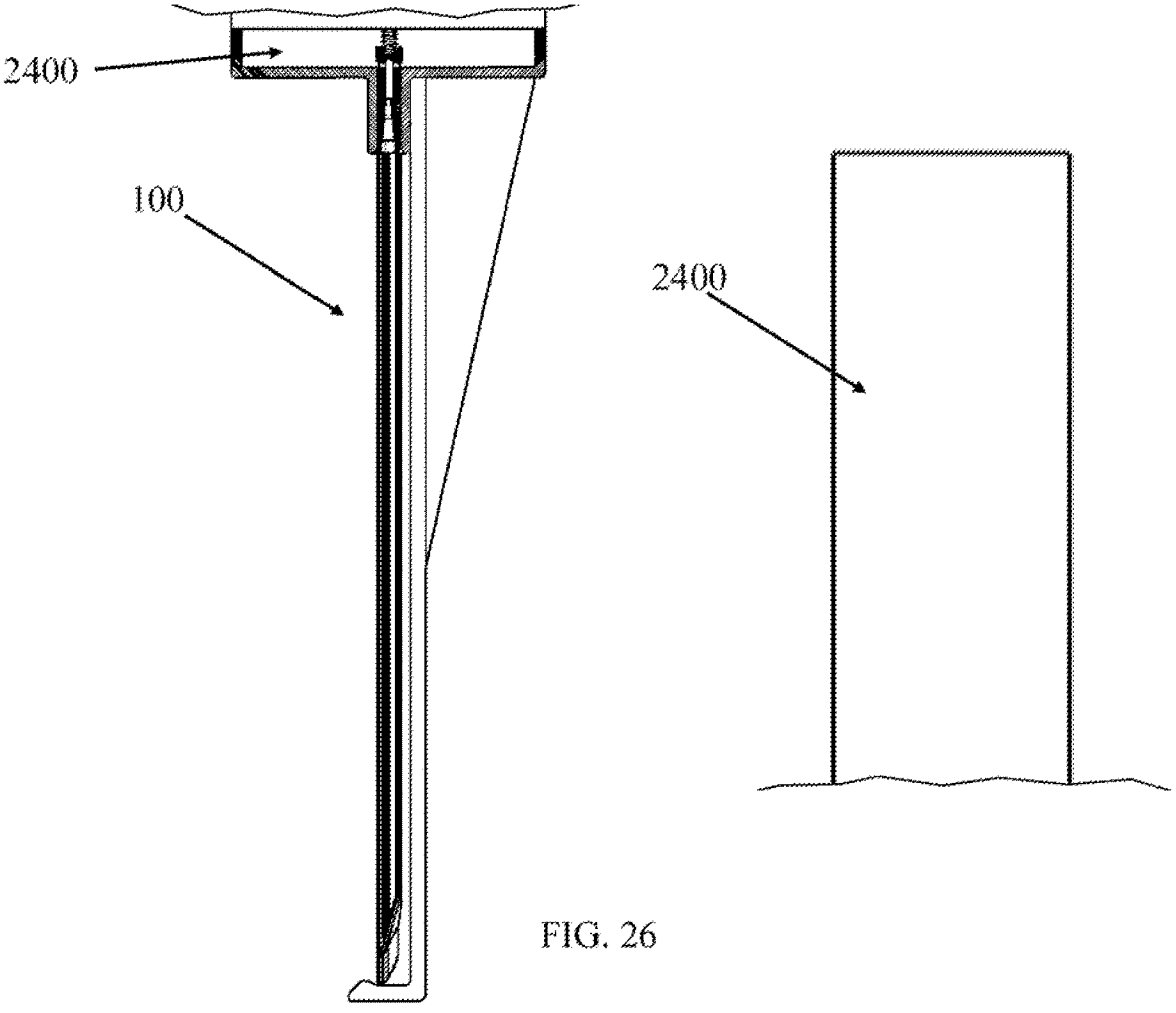
FIG. 26 Illustrates a general close up view of a side view of the main components of a liquid or gel dispenser station for a wrist band of FIG. 25.
Figure 25:
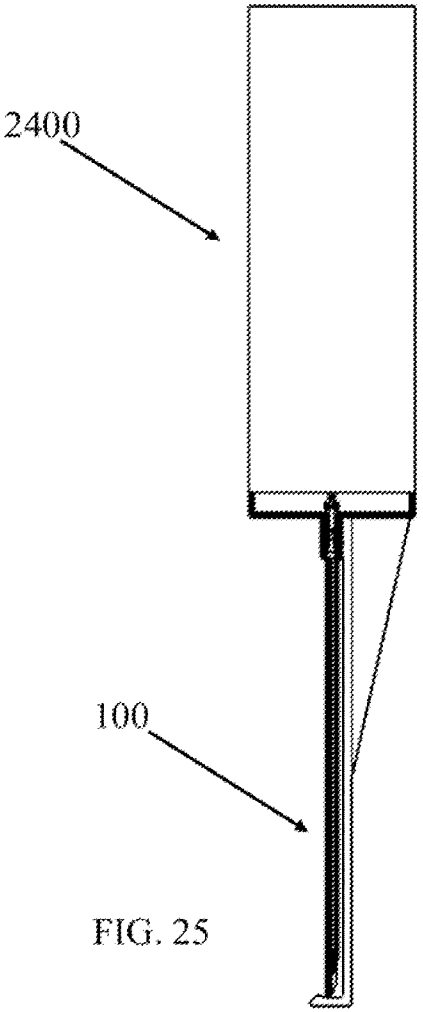
FIG. 25 Illustrates a generalized diagram of a side view of a liquid or gel dispenser station for a wrist band of FIG. 11.

FIG. 25 Illustrates a generalized diagram of a side view of a liquid or gel dispenser station 2400 for a wrist band 100 of FIG. 11. FIG. 26 Illustrates a general close up view of a side view of an exemplary liquid or gel 200 dispenser station 2400 for an exemplary wrist band 100 of FIG. 25.

Figure 27:
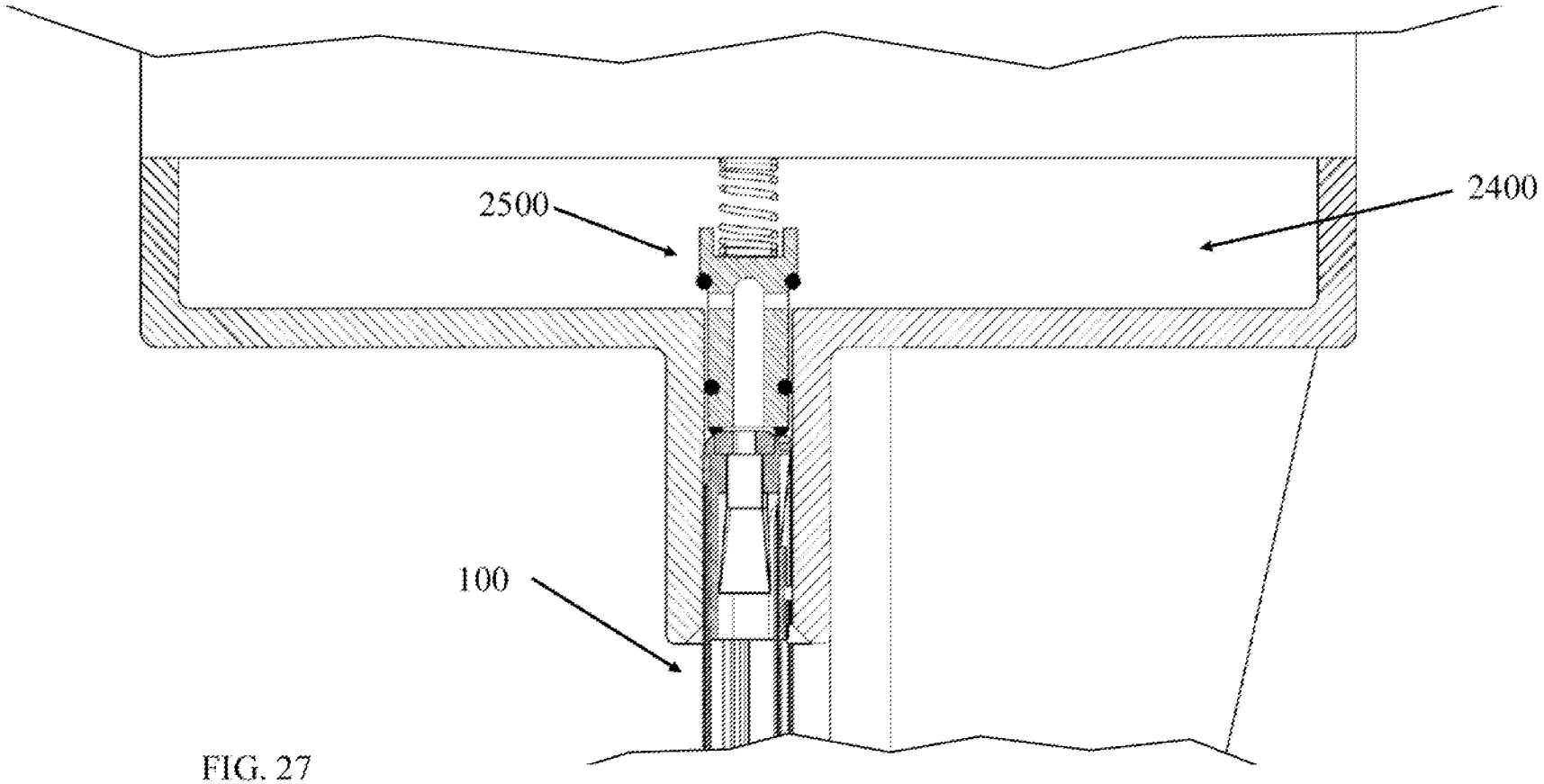
FIG. 27 Illustrates a close up view of a side view of the dispenser station interface to the dispenser end of wrist band of FIG. 12.
Figure 28:
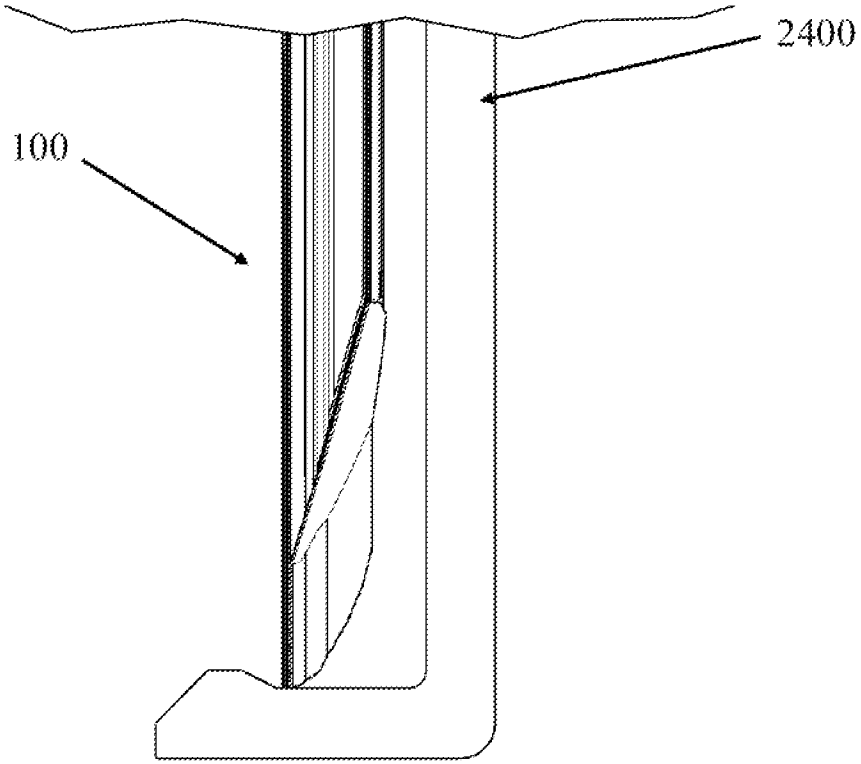
FIG. 28 Illustrates a close up view of a side view of the dispenser station interface to the non-dispenser end of wrist band of FIG. 12.

FIG. 27 Illustrates a close-up cross sectional view of a side view of the dispenser station 2400 interface to the dispenser end 800 of wrist band 100 of FIG. 12. The interface depicts a non-return spring loaded dispensing valve 2500 FIG. 28 Illustrates a close up view of a side view of an exemplary dispenser station 2400 interface to the non-dispenser end 900 of the exemplary wrist band 100 of FIG. 12.

Referring back to the FIGS. 5-10, these group of figures generally illustrate various side and isometric views of the wristband dispenser 100. FIG. 11 Illustrates a top view of wrist band in a straight form And FIGS. 12-22 generally illustrate various cross-sectional views of the wristband dispenser 100. FIG. 23 illustrates a top view of a flat spring 7 being inserted into a disposable pouch 2200 to form a dispenser 100.

FIG. 24 illustrates an elevational view of FIG. 22 in which a flat spring 7 is inserted into the disposable pouch 2200. After the disposable pouch 2200 dispenses its fluid and is in an empty state, the spring 7 may be removed and the disposable pouch 2200 thrown-way while the spring 7 can be re-used and inserted into a "full" disposable pouch which has a fluid ready for dispensing.

FIG. 25 shows three views of a dispenser 100 which may be coupled to a refill station 2400. The refill station 2400 may have fluid that is transferred into an empty dispenser 100. The interface between the dispenser 100 and the refill station 2400 may comprise a spring loaded check valve 2500 (see FIG. 25) and a back stop retainer. The fluid from the refill station 2400, such as a sanitizer, may be pumped into dispenser 100.

FIG. 26 illustrates a close-up cross-sectional view of the interface between the dispenser 100 and refill-station 2400 that includes the spring loaded check valve 2500. FIG. 27 illustrates a close-up cross-sectional view of the dispenser 100 as illustrated in FIG. 25.

One important aspect is when the dispenser 100 is being refilled, the dispenser 100 must be empty and the ziplock structures (330, 340, 430, 440 described below) are engaged (this ensures the slapband/vessel/pouch within the dispenser is deflated) prior to filling. Otherwise, the fluid from the refill station 2400 would have to contend with existing air inside the dispenser 100.

The button 310 and duckbill valve 520 as well as other elements are identified in FIG. 16. The ziplock 330, 340, 430, 440 prevents most of the backflow and allows the user to prime the wristband dispenser 100 for next use. Specifically, the internal zipper structure 330, 340, 430, 440 that is pressed together like a ziplock may prevent the back flow of gel (helps reduce the user from chasing around the liquid/gel 200 and ensures the dispenser 100 is primed for next use. Unique with the duck-bill valve 520 is the press to pour feature and inherent spring return to close. When duck-bill valve 520 is pressed, travel is limited by a duck bill valve shoulder limit 540 located on the duck-bill valve housing 510. The wristband dispenser 100 may be flexible in every axis except across the breadth of the steel spring band 7.

Exemplary dimensions for the wristband dispenser 100 and some of its sub-components are illustrated in FIG. 12 and FIG. 16. However, other dimensions (i.e. sizes) larger or smaller are possible and are included within the scope of this disclosure.

The liquid 200 that is dispensed from the dispenser 100 may comprise hand sanitizer. Hand sanitizer is a liquid, gel, or foam generally used to decrease infectious agents on the hands. The hand sanitizer may comprise some combination of isopropyl alcohol, ethanol (ethyl alcohol), or n-propanol, with versions containing between about 60.0% to about 95.0% alcohol.

However, other liquids 200 are possible and are included within the scope of this disclosure. For example, instead of hand sanitizer, the liquid 200 may comprise a soap, a beauty gel, a fragrance, sun-screen, or a lotion for moisturizing skin. Any number of liquids 200 may be employed with the inventive method and system without departing from the scope and spirit of this disclosure.

It is noted that several of the figures provide exhaustive detail which would allow one of ordinary skill in the art to make, build, and use the inventive system 100 as intended. Thus, the several figures of this disclosure are enabling to one of ordinary skill in the art. Further, text explanations may not be necessary for several of the figures since the old axiom holds true for the attached figures: a picture is worth a thousand words, as understood by one of ordinary skill in the art.

With the figures being enabled to one of ordinary skill in the art, they provide sufficient structure and detail that may be claimed in a non-provisional as set forth in 37 C.F.R. 1.83(a). That is, the drawings of the present application show every feature of the invention which would allow one of ordinary skill in the art to make, build, and use the invention. Thus, each element of the drawings may be presented in a claim as desired.

Additionally, certain steps in the processes or process flows enabled by the mechanical drawings in this specification naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention.

The materials for the parts illustrated in the several figures may include various types of polymers/plastics like silicone as well as compostable plant based resin films. Other plastics than those described above may be employed without departing from the scope of this disclosure. Further, other materials besides plastics are also possible and are included within the scope of this disclosure. Other materials besides plastics include, but are not limited to, composite materials, and any combination thereof.

Although a few embodiments have been described in detail above and illustrated in the several figures, those skilled in the art will readily appreciate that many modifications from those which were described and as illustrated are possible in the embodiments without materially departing from this disclosure. Accordingly, such modifications are intended to be included within the scope of this disclosure as defined in the following claims.

For example, while several mechanical configurations are illustrated in FIG. 13 for the valve 520, it is possible that these mechanical configurations may be replaced/substituted by additional and/or fewer structures. Further, mechanical equivalents of any of the illustrated structures, such as the duckbill valve 520, could be substituted for many of the structures illustrated in the several views as understood by one of ordinary skill in the art. Such substitutions of mechanical equivalent structures are included within the scope of this disclosure.

Similarly, in the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

PARTS LIST FOR FIGURES

100 Wrist band
200 Liquid or gel
300 Upper half
310 Dispenser button
320 Upper outer sleeve half
330 Upper left zipper half (looking from rear)
340 Upper right zipper half (looking from non-dispensing end)
400 Bottom half
410 Bottom outer sleeve half
420 Bottom inner sleeve half (looking from rear)
430 Lower left zipper half (looking from rear)
440 Lower right zipper half (looking from rear)
500 Duckbill valve assembly
510 Duckbill valve housing
520 Duckbill valve
530 Duckbill valve slit
540 Duckbill valve housing shoulder
600 Flat spring
800 Dispenser end
900 Non-dispenser end
1001 Travel direction to engage left zipper
1002 Travel direction to engage right zipper
1003 Travel direction to open duckbill valve
1004 Travel hard stop to ensure maximum valve opening
1005 Direction to push fluid towards valve (as well as close the zipper—Old Ziplock design—to prevent back flow)
2200 Disposable pouch
2400 Dispenser station
2500 Non return spring loaded dispensing valve Table 1 provided below is entitled, "Manufacturing & Materials for Parts," and lists exemplary materials that may be used for specific parts described above. Table 1 also provides suggested and known manufacturing techniques that are understood by one ordinary skill in the art. Other materials and manufacturing processes exist and are included within the scope of this disclosure.

TABLE 1

MANUFACTURING & MATERIALS FOR PARTS:

| | | Manufacturing Process | |
|---|---|---|---|
| | | High volume plastic film (Zip lock bag type production) | Silicone liquid rubber injection molding |
| 500 | Duckbill valve | Silicone | Silicone |
| 510 | Valve housing | Silicone | Silicone |
| 510 | Upper outer sleeve half | Plastic film | Silicone |
| 310 | Push button | Plastic film | Silicone |
| 340 | Upper right zipper half (looking from rear) | Extruded Polymer | Silicone |
| 410 | Bottom outer sleeve half | Plastic film | Silicone |
| 600 | Flat spring | Metal | Metal |
| 420 | Bottom inner sleeve half (looking from rear) | Plastic film | Silicone |
| 440 | Lower right zipper half (looking from rear) | Extruded Polymer | Silicone |
| 200 | Liquid Gel content | Liquid Gel | Liquid Gel |

It is the express intention of the applicant not to invoke 35 U.S.C. § 112, sixth paragraph for any limitations of any of the claims herein (or in future cases), except for those in which the claim expressly uses the words 'means for' together with an associated function.

Therefore, although selected aspects have been illustrated and described in detail, it will be understood that various substitutions and alterations may be made therein without departing from the spirit and scope of the present invention, as defined by the following claims.

What is claimed is:

1. A system for providing a wearable wristband, comprising:
- a button;
- a valve coupled to the button;
- a housing coupled to the valve;
- a container coupled to the housing, the container holding sanitizer;
- a flat spring coupled to the container;
- a zipper structure that prevents back flow of the sanitizer stored in the container; wherein the valve is located at an end of the container and oriented down such that hand sanitizer is assisted by gravity when released; and
- a valve housing that protrudes higher on either side of the valve to prevent accidental activation of the valve.

2. The system of claim 1, wherein the flat spring when bent into an arc compresses a fluid or hand sanitizer when coupled to the container throughout a majority of its length.

3. The system of claim 2, wherein the compression of fluid or hand sanitizer stretches the container as one means of priming the valve ready for use.

4. The system of claim 1, wherein the container conforms to a shape of a wrist of a human when it is bent over the wrist of a human, the container locking into the shape after it is bent.

5. The system of claim 3, wherein closing the zipper structure pushes fluid or hand sanitizer towards a valve end of the container.

6. The system of claim 1, wherein the valve is biased to automatically close after being activated and limits opening of the valve when being activated.

7. The system of claim 5, wherein the travel of the valve when opened is limited by a shoulder stop integrated into the valve housing on either side of the valve.

8. The system of claim 6, wherein the valve is activated only through the use of a pinch grip or thumb press.

9. The system of claim 1, wherein the valve, valve housing, and container are made from one piece liquid injection molded silicon over a mold on a metal spring.

10. The system of claim 1, wherein the zipper structure closes down the container to remove most of the air and a non-return valve enables automatic valve opening for filling and closing when filled.

* * * * *